US012264416B2

(12) United States Patent
Mincey et al.

(10) Patent No.: US 12,264,416 B2
(45) Date of Patent: Apr. 1, 2025

(54) METHODS AND COMPOSITIONS FOR SUSTAINABLE TEXTILE MATERIALS

(71) Applicant: SOARCE, INC., Orlando, FL (US)

(72) Inventors: Mason R. A. Mincey, Orlando, FL (US); Derek G. Saltzman, Orlando, FL (US)

(73) Assignee: SOARCE, INC., Orlando, FL (US)

( * ) Notice: Subject to any disclaimer, the term of this patent is extended or adjusted under 35 U.S.C. 154(b) by 0 days.

(21) Appl. No.: 18/432,817

(22) Filed: Feb. 5, 2024

(65) Prior Publication Data

US 2024/0271334 A1 Aug. 15, 2024

Related U.S. Application Data

(60) Provisional application No. 63/443,145, filed on Feb. 3, 2023.

(51) Int. Cl.
*D01F 8/02* (2006.01)
*D01F 8/18* (2006.01)

(52) U.S. Cl.
CPC ..... *D01F 8/02* (2013.01); *D01F 8/18* (2013.01); *D10B 2101/14* (2013.01); *D10B 2201/20* (2013.01)

(58) Field of Classification Search
CPC ..... D01F 8/02; D01F 8/18; D10B 2101/14; D10B 2201/20; B65D 81/266; C01B 21/064; C08J 3/215; C08J 5/18; C08K 3/38; C08K 2003/385; C08K 2201/0132
USPC ..... 428/366
See application file for complete search history.

(56) References Cited

U.S. PATENT DOCUMENTS

| | | | |
|---|---|---|---|
| 2,303,773 | A | 12/1942 | Thackston |
| 2008/0242176 | A1 | 10/2008 | Jaeger et al. |
| 2011/0045223 | A1 | 2/2011 | Lin et al. |
| 2016/0289893 | A1 | 10/2016 | Martin et al. |

(Continued)

FOREIGN PATENT DOCUMENTS

KR 20200073189 * 6/2020

OTHER PUBLICATIONS

Chu et al., "Construction of hierarchal natural fabric surface based on wo-Dimensional Boron Nitride Nanosheets and Its Application for Preparing Biobased Toughened Unsaturated Polyester Resin Composites." ACS Appl Mater Interfaces. Nov. 21, 2018;10(46).

(Continued)

*Primary Examiner* — Camie S Thompson
(74) *Attorney, Agent, or Firm* — Thomas|Horstemeyer, LLP

(57) ABSTRACT

In one aspect, the disclosure relates to compositions that can have improved thermal management properties, UV-absorbing properties, anti-bacterial properties, and/or fire-resistance properties that utilize sustainable materials and can be used to fabricate filaments, yarns, fabrics, and artificial leather. The disclosed compositions can comprise a boron nitride nanomaterial and a cellulose nanomaterial. The disclosed compositions can also comprise a boron nitride nanomaterial, a cellulose nanomaterial, and an alginate material. This abstract is intended as a scanning tool for purposes of searching in the particular art and is not intended to be limiting of the present disclosure.

18 Claims, 11 Drawing Sheets

(56) References Cited

U.S. PATENT DOCUMENTS

2017/0225951 A1 8/2017 Marsh et al.
2019/0382561 A1* 12/2019 Janowska ..... C08L 89/00

OTHER PUBLICATIONS

Chung, et al. "Durable press and antimicrobial finishing of cotton fabrics with a citric acid and chitosan Treatment. Textile Research Journal." 1998;68(10):772-775.
Wang Z et al. Scalable preparation of 2D boron nitride nanosheets and enhancement of UV absorption and thermal conductivity of cellulose nanofibers membrane. J Mater Sci 55, 13815-13823 (2020).

* cited by examiner

METHODS AND COMPOSITIONS FOR SUSTAINABLE TEXTILE MATERIALS

CROSS-REFERENCE TO RELATED APPLICATIONS

This application claims the benefit of U.S. Provisional Application No. 63/443,145, filed on Feb. 3, 2023, which is incorporated herein by reference in its entirety.

BACKGROUND

The textile industry is a significant contributor to global carbon dioxide emissions, exceeding those from several other sectors such as international aviation and shipping, due in part, to lengthy supply chains and energy intensive production methods (W.L. Filho, et al., Front. Environ. Sci. at DOI: 10.3389/fenvs.2022.973102). Many of the materials utilized in the textile industry are based on petrochemical materials such as polyethers and polyamides, e.g., the use of synthetic fibers has grown exponentially and use of polyester in textiles surpasses cotton as the most widely used fabric in fashion products (ibid). Synthetic fibers and yarns have a much greater carbon footprint natural materials such as cotton because they require petroleum-based products as a feedstock. Not surprisingly, the textile industry is under increasing pressure to utilize textile materials that are sustainable and minimally impactful to the environment.

Despite advances in textile research, there is still a scarcity of materials that meeting the increasing needs for sustainable textile materials. These needs and other needs are satisfied by the present disclosure.

SUMMARY

In accordance with the purpose(s) of the present disclosure, as embodied and broadly described herein, the disclosure, in one aspect, compositions that can have improved thermal management properties, UV-absorbing properties, anti-bacterial properties, and/or fire-resistance properties that utilize sustainable materials and can be used to fabricate filaments, yarns, fabrics, and artificial leather.

In one aspect, the present disclosure relates comprising a boron nitride nanomaterial and a cellulose nanomaterial.

In a further aspect, the present disclosure relates to compositions comprising a boron nitride nanomaterial, a cellulose nanomaterial, and an alginate material.

In a further aspect, the present disclosure relates to filaments comprising a disclosed composition.

In a further aspect, the present disclosure relates to an artificial leather material comprising a disclosed composition.

In a further aspect, the present disclosure relates to yarns comprising a disclosed filament or a disclosed composition.

In a further aspect, the present disclosure relates to fabrics comprising a disclosed yarn.

In a further aspect, the present disclosure relates to articles comprising a disclosed filament, a disclosed yarn, a disclosed artificial leather and/or a disclosed fabric.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIG. 1A shows a representative electron micrograph of cellulose nanocrystals from the prior art. FIG. 1B shows a representative electron micrograph of cellulose nanofibrils from the prior art.

FIG. 3A shows a crystal structure for hexagonal boron nitride with dimensional information, as well as intramolecular and intermolecular bonds from the prior art. FIG. 3B shows a representative electron micrograph of boron nitride crystals from the prior art.

FIG. 6A shows a sodium alginate control film, i.e., a 2 wt % sodium alginate film lacks a disclosed boron nitride composition at 12 seconds exposure to an open flame.

FIG. 6B shows a disclosed film comprising 2 wt % sodium alginate and 2 wt % of a disclosed composition comprising boron nitride and cellulose nanocrystals, at 12 seconds exposure to an open flame. FIG. 6C shows the disclosed film of FIG. 6B with the open flame extinguished and showing a simple charring of the disclosed film.

FIG. 8A shows schematic depiction of the testing method comprising a UV emission array, a sample, and then a receiver capable of detecting UV energy. FIG. 8B shows representative data for a disclosed material comprising a 1:1 weight ratio of CNC and hBN with each at 1 wt % prepared as described herein compared to a control measurement (fixed calibration with no sample in front of emitter and analyzer). The data show that the disclosed material absorbed 100% of UV-C and 93% of UV-A, whereas a sample comprising only alginate absorbed 86% of UV-C and 0.7% UV-A.

FIG. 10A shows a representative ATR-FTIR spectrograph obtained from a dry hBN sample as received from a supplier. FIG. 10B shows a representative ATR-FTIR spectrograph obtained from an aqueous suspension of a hBN/CNC sample prepared as disclosed herein. FIG. 10C shows a representative ATR-FTIR spectrograph obtained from an aqueous suspension of a hBN/CNC sample following exfoliation prepared as disclosed herein. FIG. 10D shows a representative ATR-FTIR spectrograph obtained from a dry powder CNC sample as received from a supplier. FIG. 10E shows a representative ATR-FTIR spectrograph obtained from an aqueous dispersion of a dry powder CNC sample prepared as described herein.

Figure 1A:
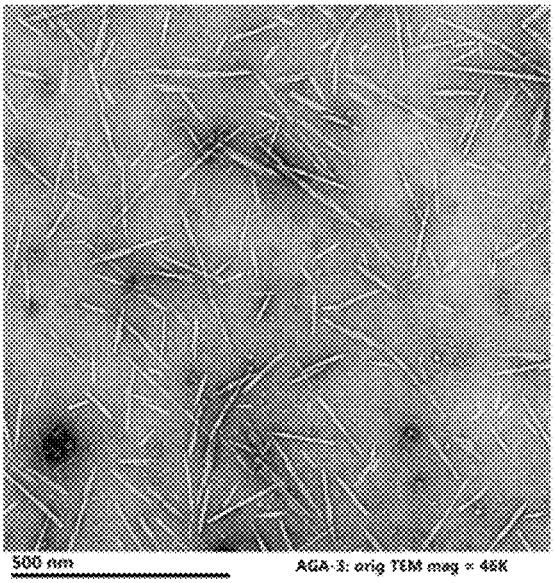
FIGS. 1A-1B show representative prior art electron micrographs showing structures of materials used in the disclosed compositions (Source: https://www.fpl.fs.usda.gov/research/highlights/highlight.php?high id=1284; checked Feb. 1, 2023).

Additional advantages of the disclosure will be set forth in part in the description which follows, and in part will be obvious from the description, or can be learned by practice of the disclosure. The advantages of the disclosure will be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION

Many modifications and other embodiments disclosed herein will come to mind to one skilled in the art to which the disclosed compositions and methods pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of the appended claims. The skilled artisan will recognize many variants and adaptations of the aspects described herein. These variants and adaptations are intended to be included in the teachings of this disclosure and to be encompassed by the claims herein.

Although specific terms are employed herein, they are used in a generic and descriptive sense only and not for purposes of limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure.

Any recited method can be carried out in the order of events recited or in any other order that is logically possible. That is, unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present disclosure is not entitled to antedate such publication by virtue of prior disclosure. Further, the dates of publication provided herein can be different from the actual publication dates, which can require independent confirmation.

While aspects of the present disclosure can be described and claimed in a particular statutory class, such as the system statutory class, this is for convenience only and one of skill in the art will understand that each aspect of the present disclosure can be described and claimed in any statutory class.

It is also to be understood that the terminology used herein is for the purpose of describing particular aspects only and is not intended to be limiting. Unless defined otherwise, all technical and scientific terms used herein have the same meaning as commonly understood by one of ordinary skill in the art to which the disclosed compositions and methods belong. It will be further understood that terms, such as those defined in commonly used dictionaries, should be interpreted as having a meaning that is consistent with their meaning in the context of the specification and relevant art and should not be interpreted in an idealized or overly formal sense unless expressly defined herein.

Prior to describing the various aspects of the present disclosure, the following definitions are provided and should be used unless otherwise indicated. Additional terms may be defined elsewhere in the present disclosure.

Definitions

As used herein, "comprising" is to be interpreted as specifying the presence of the stated features, integers, steps, or components as referred to, but does not preclude the presence or addition of one or more features, integers, steps, or components, or groups thereof. Moreover, each of the terms "by", "comprising," "comprises", "comprised of," "including," "includes," "included," "involving," "involves," "involved," and "such as" are used in their open, non-limiting sense and may be used interchangeably. Further, the term "comprising" is intended to include examples and aspects encompassed by the terms "consisting essentially of" and "consisting of." Similarly, the term "consisting essentially of" is intended to include examples encompassed by the term "consisting of.

As used in the specification and the appended claims, the singular forms "a," "an" and "the" include plural referents unless the context clearly dictates otherwise. Thus, for example, reference to "a polymer," "a yarn," or "a fabric," including, but not limited to, two or more such polymers, yarns, or fabrics, and the like.

It should be noted that ratios, concentrations, amounts, and other numerical data can be expressed herein in a range format. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. Ranges can be expressed herein as from "about" one particular value, and/or to "about" another particular value. Similarly, when values are expressed as approximations, by use of the antecedent "about," it will be understood that the particular value forms a further aspect. For example, if the value "about 10" is disclosed, then "10" is also disclosed.

When a range is expressed, a further aspect includes from the one particular value and/or to the other particular value. For example, where the stated range includes one or both of the limits, ranges excluding either or both of those included limits are also included in the disclosure, e.g., the phrase "x to y" includes the range from 'x' to 'y' as well as the range greater than 'x' and less than 'y'. The range can also be expressed as an upper limit, e.g., 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In addition, the phrase "about 'x' to 'y'", where 'x' and 'y' are numerical values, includes "about 'x' to about 'y'".

It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., about 1%, about 2%, about 3%, and about 4%) and the sub-ranges (e.g., about 0.5% to about 1.1%; about 5% to about 2.4%; about 0.5% to about 3.2%, and about 0.5% to about 4.4%, and other possible sub-ranges) within the indicated range.

As used herein, the terms "about," "approximate," "at or about," and "substantially" mean that the amount or value in question can be the exact value or a value that provides equivalent results or effects as recited in the claims or taught herein. That is, it is understood that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In some circumstances, the value that provides equivalent results or effects cannot be reasonably determined. In such cases, it is generally understood, as used herein, that "about" and "at or about" mean the nominal value indicated ±10% variation unless otherwise indicated or inferred. In general, an amount, size, formulation, parameter or other quantity or characteristic is "about," "approximate," or "at or about" whether or not expressly stated to be such. It is understood that where "about," "approximate," or "at or about" is used before a quantitative value, the parameter also includes the specific quantitative value itself, unless specifically stated otherwise.

As used herein the terms "weight percent," "wt %," and "wt. %," which can be used interchangeably, indicate the percent by weight of a given component based on the total weight of a composition of which it is a component, unless otherwise specified. That is, unless otherwise specified, all wt % values are based on the total weight of the composition. It should be understood that the sum of wt % values for all components in a disclosed composition or formulation are equal to 100. Alternatively, if the wt % value is based on the total weight of a subset of components in a composition, it should be understood that the sum of wt % values the specified components in the disclosed composition or formulation are equal to 100.

As used herein, the term "effective amount" refers to an amount that is sufficient to achieve the desired modification of a physical property of the composition or material. For example, an "effective amount" of a cooling composition refers to an amount that is sufficient to achieve the desired improvement in the property modulated by the disclosed compositions, e.g., achieving the desired enhancement in flame resistance, thermal conductivity, and/or UV absorption compared to a yarn or fabric without the effective amount of disclosed composition. The specific level in terms of wt % in a composition required as an effective amount will depend upon a variety of factors including the amount and type of polymer and yarn, fabric use, and the like.

The term "nanoparticle" as used herein comprises a nanoscale deposit of a homogenous or heterogeneous material. Nanoparticles may be regular or irregular in shape and may be formed from a plurality of co-deposited particles that form a composite nanoscale particle. Nanoparticles may be generally spherical in shape or have a composite shape formed from a plurality of co-deposited generally spherical particles. Exemplary shapes for the nanoparticles include, but are not limited to, spherical, rod, elliptical, cylindrical, disc, and the like. In some embodiments, the nanoparticles have a substantially spherical shape.

As used herein, "nanocellulose" refers to a cellulose-based material, in which the median length of particles in at least one dimension is less than about 100 nm. Cellulose refers to a linear polysaccharide material comprising repeating ß-d-glucopyranose molecules having a chemical structure as shown immediately below.

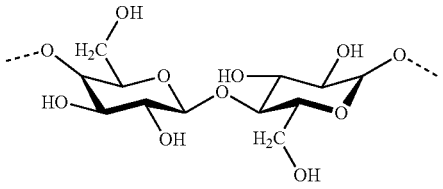

The term "nanoscale" as used herein comprises a surface having a measurable feature in the range of from about 1 to about 1000 nm.

The term "nanoparticle" as used herein comprises a nanoscale deposit of a homogenous or heterogeneous material. Nanoparticles may be regular or irregular in shape and may be formed from a plurality of co-deposited particles that form a composite nanoscale particle. Nanoparticles may be generally spherical in shape or have a composite shape formed from a plurality of co-deposited generally spherical particles. Exemplary shapes for the nanoparticles include, but are not limited to, spherical, rod, elliptical, cylindrical, disc, and the like. In some embodiments, the nanoparticles have a substantially spherical shape.

As used herein, the term "fiber" refers to refers to any slender, elongated structure that can be carded, combed, or otherwise formed into a thread or filament. A fiber can comprise a natural material (e.g., cotton, linen or wool) or an artificial material (e.g., nylon, polyester). A fiber is a material in which the length to diameter ratio is greater than about 10. Fiber is typically classified according to its fineness. Fiber is generally defined as having a fiber fineness greater than about 15 Denier, usually greater than about 30 Denier. Fine Denier fiber generally refers to a fiber having a fineness less than about 15 Denier. Examples of fibers include "staple fibers", a term that is well-known in the textile art. A reference to "fiber" of "fibers" may mean or include individual fibers or a plurality or bulk of fibers as the situation requires. A plurality of fibers may comprise fibers of different compositions or may be substantially uniform in composition. Thus, by way of illustration, a reference to "natural fiber" or "synthetic fiber" may mean and may include a single fiber of such type or may mean any quantity or plurality of such fibers and they may be comprised in threads, felts, yarns, fabrics materials etc., all as will be apparent from the context.

The fiber can be a synthetic fiber or a natural or organic fiber. As one of skill in the art is well aware, smoothness of the outer surfaces is significantly varied between different fibers. Accordingly, the outer surface of the fiber can be smooth or rough. By way of example only, manmade fibers, such as polyester fibers, usually have a smooth outer surface. In contrast, natural fibers, such as cotton, usually have a rough outer surface. One consequence of the roughness of the outer surface is that rough surfaces take more fluid to completely cover the surface per unit diameter.

As used herein, "fiber" refers to any one of the various types of matter that form the basic elements of a textile and that is characterized by a flexible, macroscopically homogeneous body having a high ratio of length to width and being small in cross section, and may include one or more fibrous materials (e.g., fibers or filaments). It is understood that "fiber" includes "filaments." A fiber can then be texturized directly (which is uncommon), or can be combined with other filaments to form a filament bundle with the resultant filament bundle can then be texturized.

As used herein, "filament" refers generally to a continuous fiber of extremely long length, whereas a "staple fiber" means a fiber of finite length. A staple fiber can be a natural fiber or a fiber cut from, for example, a filament.

The term "yarn" refers a structure comprising a plurality of fibers that have been twisted, spun or otherwise joined together to form the yarn and may include spun yarns, continuous filament yarns, and yarns of core spun construction. The strands that that have been twisted, spun or otherwise joined together can be of natural or synthetic material, such as wool, nylon, or polyester, in a form suitable for sewing, knitting, weaving, or otherwise intertwining to form a textile fabric. In general, "yarn" refers to a product obtained when fibers are aligned. Yarns are products of substantial length and relatively small cross-section. Yarns may be single ply yarns, that is, having one yarn strand, or multiple ply yarns, such as 2-ply yarn that comprises two single yarns twisted together or 3-ply yarn that comprises three yarn strands twisted together. In various aspects, the disclosed composite fibers are used to prepare disclosed yarns. The disclosed yarns can be formed using staple fibers, using continuous fibers, or combinations thereof.

As used herein, "multifilament" means a yarn consisting of many continuous filaments or strands, as opposed to monofilament which is one strand. Most textile filament yarns are multifilament.

As used herein, the term "filament yarn" refers to a yarn that is composed of more than one fiber filaments that run the whole length of the yarn. Filament yarns can also be referred to as multi-filament yarns. The structure of a filament yarn is influenced by the amount of twist, and in some cases the fiber texturing. The properties of the filament yarn can be influenced by the structure of the yarn, fiber to fiber friction of the constituent fibers, and the properties of the constituent fibers. In some embodiments, the yarn structure and the recombinant protein fiber properties are chosen to impart various characteristics to the resulting yarns. The properties of the yarn can also be influenced by the number of fibers (i.e., filaments) in the yarn. The filament yarns disclosed herein can be multifilament yarns. Throughout this disclosure "filament yarns" can refer to flat filament yarns, textured filament yarns, drawn filament yarns, undrawn filament yarns, or filament yarns of any structure.

As used herein, the term "spun yarn" refers to a yarn that is made by twisting staple fibers together to make a cohesive yarn (or thread, or "single"). The structure of a spun yarn is influenced by the spinning methods parameters. The properties of the spun yarn are influenced by the structure of the yarn, as well as the constituent fibers.

As used herein, the term "blended yarn" refers to a type of yarn comprising various fibers being blended together.

As used herein, the term "textile" shall mean a fiber, filament, yarn, fabric, or any article comprising fabrics and/or yarns, such as garments, articles of clothing, home goods, including, but not limited to, bed and table linens, linens, draperies and curtains, and upholsteries, and the like.

The term "articles of clothing" include any article of clothing including, for example, underwear, t-shirts, shirts, pants, socks, hats, diapers, and jackets.

As used herein, the term "garment" refers to wearable articles comprising fabrics or cloth to any item that is covers or protects some region of the user's body from weather or other factors in the environment outside the body. Exemplary garments, include, but are not limited to, coats, jackets, pants, hats, gloves, shoes, socks, shirts, blouses, dresses, coats, and the like. It is noted that the term "garment" is intended to cover clothing for human or animal use.

The term "linen" as used herein, refers to any article routinely washed in a residential or commercial washing machine besides articles of clothing, including, for example, sheets, blankets, towels, drapery, wash cloths, napkins, tablecloths, and pillowcases.

As used herein, the term "fabric" is to be understood in its widest meaning. The term "fabric" may be used for all structures composed of fibers which have been manufactured according to a surface-forming method. Fabrics include materials where one or more different types of yarns, threads, filaments, or fibers that have been woven, knitted, felted, wrapped, spun, co-mingled, coated, coextruded, braided, entangled, applied or otherwise assembled into a desired material. Generally, the fabric has a structure which comprises a series of meshes or openings and filament bundles which define the mesh boundaries, such as woven, knitted, knotted, interwoven or tufted structures. Without limitations, the term "fabric" is intended to include woven fabrics, yarn sheets, knitted fabrics and non-woven fabrics. Further, the fabrics may be constructed from a combination of fibers, threads or yarns. Fabrics comprising different fibers, threads or yarns are also referred to as fabric blends herein. A knitted fabric may be flat knit, circular knit, warp knit, narrow elastic, and lace. A woven fabric may be of any construction, for example sateen, twill, plain weave, oxford weave, basket weave, and narrow elastic and the like.

As used herein, the term "cloth" refers to any textile fabric woven, nonwoven, felted, knitted or otherwise formed from any filament or fiber or plurality of filaments or fibers, including but not limited to thread yarn, monofilaments, and ribbons. Further, the term cloth is intended to include within its scope not only woven, knitted, non-woven, and felted materials, but also sheet materials.

As used herein, the terms "optional" or "optionally" means that the subsequently described event or circumstance can or cannot occur, and that the description includes instances where said event or circumstance occurs and instances where it does not.

Unless otherwise specified, temperatures referred to herein are based on atmospheric pressure (i.e., one atmosphere).

Abbreviations used herein throughout are as follows:

| Abbreviation | Meaning |
|---|---|
| ALG | Alginate material |
| BNNS | Boron nitride nanosheets |
| CBM | Carboxymethylcellulose |
| CNC | Cellulose nanocrystals |
| CNF | Cellulose nanofibers |
| CNM | Cellulose nanomaterial such as a CNC, CNF, or TCNF |
| CM | Cellulose material such as CNMs, both exfoliated and pristine, and materials such as CBM or other celluloses. |
| DI | Deionized water |
| FR | Fire resistant |
| hBN | Hexagonal boron nitride |
| SA | Sodium Alginate |
| TCNF | TEMPO-oxidized CNF |
| TEMPO | 2,2,6,6-tetramethylpiperidine-1-loxy |

CNM-hBN and CNM-hBN-ALG Compositions

In various aspects, the disclosed compositions comprise a boron nitride nanomaterial and a cellulose material. In a further aspect, the disclosed compositions comprise a boron nitride nanomaterial and a cellulose nanomaterial, a cellulose material, and combinations thereof. In a still further aspect, the disclosed compositions comprise a boron nitride nanomaterial and a cellulose nanomaterial. Exemplary cellulose nanomaterials useful for the disclosed compositions include cellulose nanocrystals, cellulose nanofibers, and mixtures thereof.

In various aspects, the disclosed compositions comprise a boron nitride nanomaterial, a cellulose material, and an alginate material. In a further aspect, the disclosed compositions comprise a boron nitride nanomaterial; a cellulose nanomaterial, a cellulose material, and combinations thereof; and an alginate material. In a still further aspect, the disclosed compositions comprise a boron nitride nanomaterial, a cellulose nanomaterial, and an alginate material. Exemplary alginate materials are described herein below.

In various aspects, a cellulose material can comprise one or more cellulose materials, including any of the disclosed CNMs, a cellulose material such as CBM, and any of the foregoing cellulose materials as pristine cellulose materials, modified cellulose materials, and/or exfoliated cellulose materials.

Figure 1B:
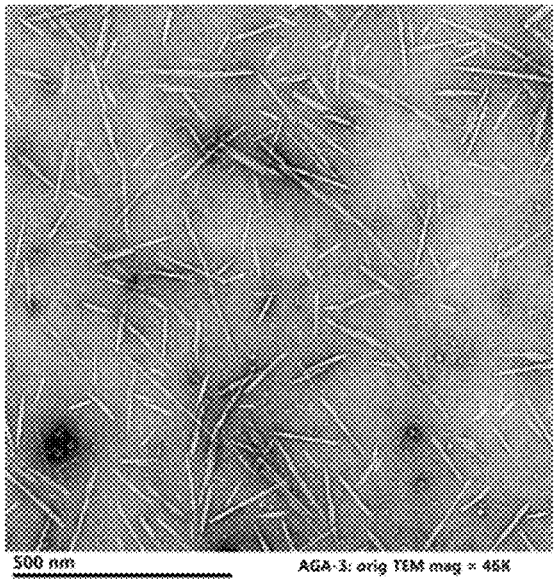

In various aspects, nanocellulose used in the present disclosure can be extracted from softwoods, hardwoods, macro algae, micro algae, bacteria, fungi, and tunicates. In a further aspect, the nanocellulose material can comprise a variety of morphologies such as those classified as cellulose nanocrystals, cellulose crystallites, cellulose nano whiskers, microcrystalline cellulose, nanofibrils, cellulose cellulose nanofibers, 2,2,6,6-Tetramethylpiperidinyloxy (TEMPO) oxidized cellulose nanofibers. Cellulose can range in molecular weight from $3\times10^4$-$2\times10^5$ g mol−1. Exemplary cellulose nanomaterials are shown in FIGS. 1A-1B.

Figure 3A:
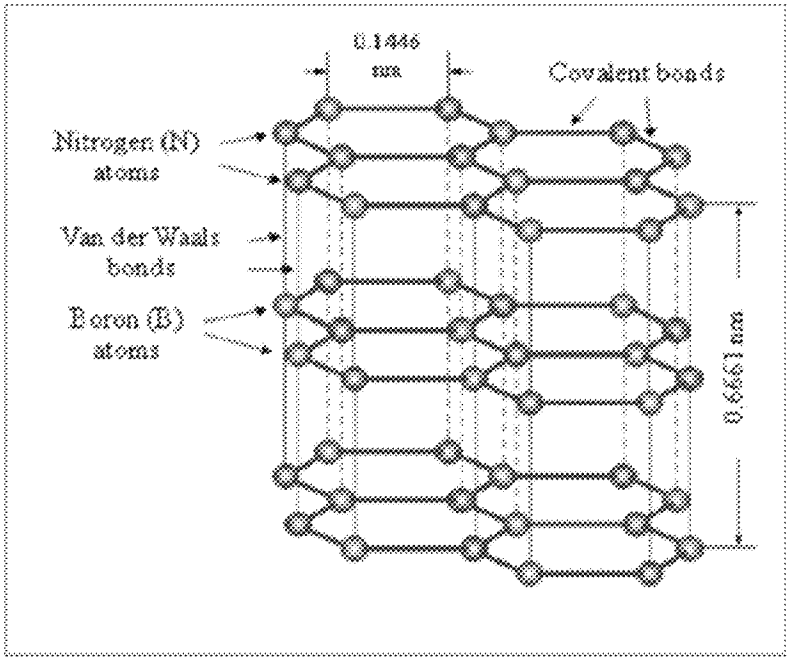
FIGS. 3A-3B show a crystal structure and a representative electron micrograph relating to hexagonal boron nitride, a material used in the disclosed compositions.
Figure 3B:
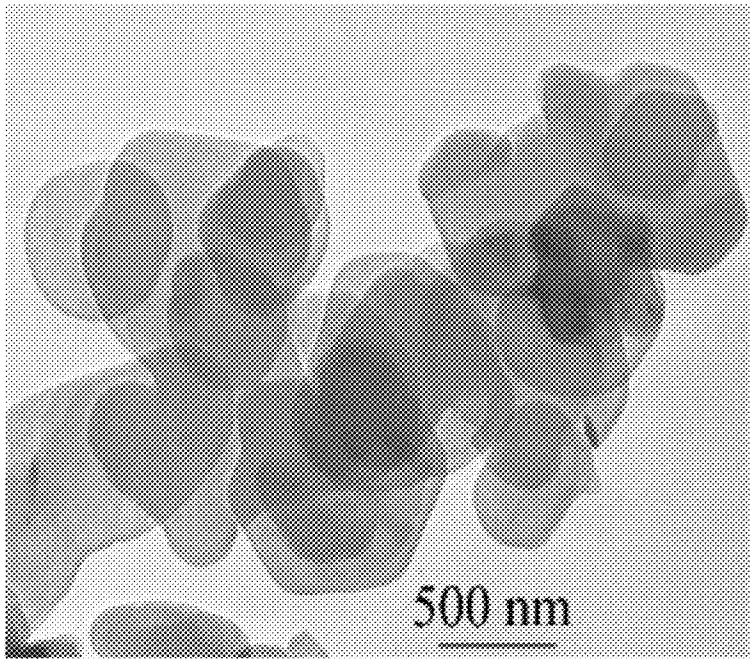
Figure 4:
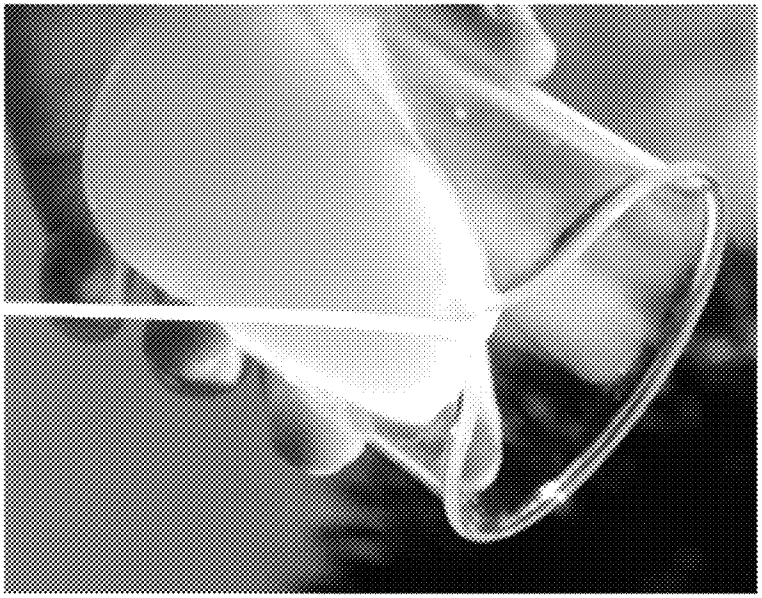
FIG. 4 shows a representative photographic image of a disclosed composition demonstrating effective dispersion of the components in the disclosed composition.

In a further aspect, the disclosed compositions comprise hexagonal boron nitride (hBN) which is a boron nitride nanomaterial having a hexagonal crystalline structure of atomically flat layers of alternating B and N atoms held loosely together by van der Waals. Its crystalline arrangement is composed of sp2 hybridized and highly polar B—N bonds. In a further aspect, the methods disclosed herein to make the disclosed composition utilize hBN to form nanostructures in the disclosed composition such as boron nitride nanosheets and/or boron nitride nanotubes. Thus, the disclosed compositions can comprise a mixture of hBN, boron nitride nanosheets (BNNS), and/or boron nitride nanotubes. In some aspects, the disclosed compositions comprise >50% by weight of the boron nitride in the form of boron nitride nanosheets. The disclosed methods to make the disclosed compositions utilize mechanical cleavage to convert bulk hBN under high shear forces to reduce the layers. The thermal, UV, and anti-bacterial properties of the disclosed compositions are due, in part, to the presence of hBN, boron nitride nanosheets, and/or boron nitride nanotubes. In the present disclosure, bulk hBN ranges from 0.1-500 microns in length and 100 nm-800 nm in thickness, whereas the BNNS can be on average 10 nm in thickness. Exemplary hBN materials and their crystal structure are shown in FIGS. 3A-3B.

Without wishing to be bound by a particular theory, it is believed that hydroxyl groups of nanocellulose materials participate in hydrogen bonding with hydroxylated edges of hBN and hydrophobic interaction. Due to these chemical interactions, nanocellulose acts as an effective dispersal agent for the hBN that mitigates or minimizes hBN from agglomerating and settling in solution. The examples herein below demonstrate the success of using high shear forces and cellulosic polymers to acquire exfoliated BNNS resulting in a stable solution.

Figure 2:
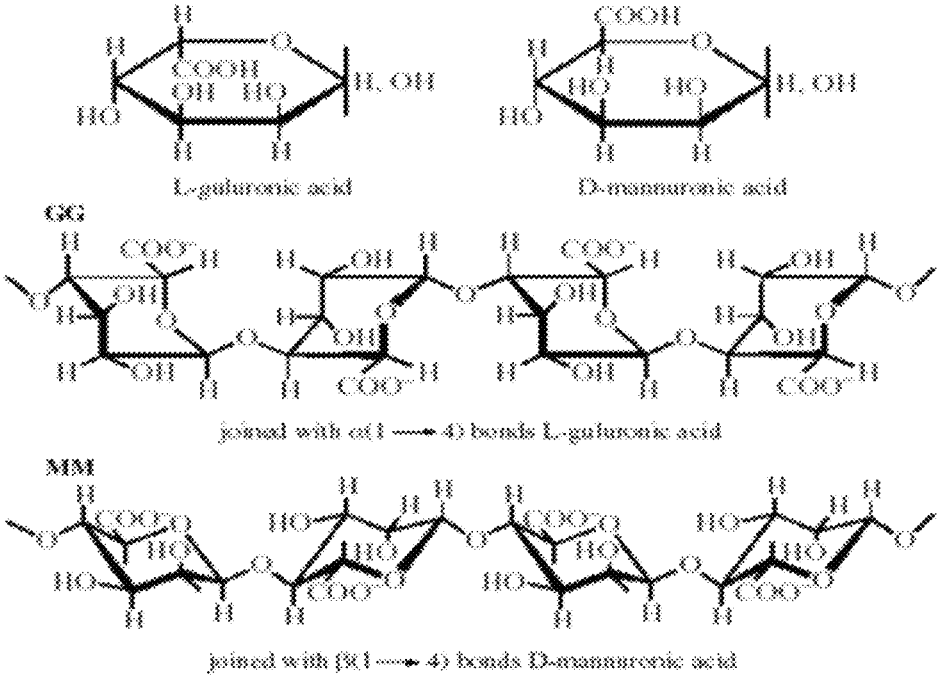
FIG. 2 shows a chemical structure for sodium alginate. In the figure "GG" denotes a L-glucuronic polymer structure, and "MM" denotes a mannuronic block polymer structure.

Alginate used in the disclosed compositions can be extracted from brown algae (pheophyta) of the genera Macrocystis, *Laminaria*, Ascophyllum, Alario, Ecklonia, Eisenia, Nercocystis, Sargassum, Cystoseira, and Fucus. The alginate structure is composed of linear, unbranched polysaccharide monomers β-D mannuronic acid blocks and α-L guluronic acid blocks. Insoluble protonated alginate can be readily converted to a soluble salt form, e.g., sodium alginate (SA), calcium alginate, potassium alginate, and/or ammonium alginate, by methods known in the art. In further aspects, the alginate used can be an ester modified alginate, e.g., propylene glycol alginate, but other ester forms can be used as well. In various aspects, the alginate used in the disclosed compositions can possess a viscosity range between 20-400 centipoises when determined using a 1 wt % aqueous solution at 20° C. In a further aspect, the alginate used in the disclosed compositions can possess a viscosity range between 20 mPa·s-1500 mPa·s when determined using a 1 wt % aqueous solution at 20° C. The molecular weight of alginate used in the final composition can range from 32,000 to 200,000 with a degree of polymerization from 180 to 930. Exemplary chemical structures for SA are depicted in FIG. 2.

Further, without wishing to be bound by a particular theory, it is believed that alginate and nanocellulose participate in intermolecular interactions between the COO— of alginate and the hydroxyl groups of nanocellulose to form a crosslinked network. Once the divalent cation is introduced into the hBN, nanocellulose, sodium alginate mixture, an "eggbox" structure is formed as disclosed by the figure below. The final composition contains nanocellulose that is believed to form interactions between the hydroxylated edges of boron nitride along with the COO group of sodium alginate which is then gelled due to ion exchange of alginate's sodium ion with a divalent cation.

Hexagonal boron nitride is known to have thermal conductivities values from 550 W $m^{-1}$ $K^{-1}$ to 751 W $m^{-1}$ $K^{-1}$ at room temperature. Due to the atomically small layers and large lateral dimensions, when hBN/BNNS is added to the disclosed composition, the mean free path of phonon transfer is minimized. This phenomenon enhances the filaments formed such that they can have enhanced thermal conductivities of from 0.5 $Wm^{-1}$ $K^{-1}$ to 100 W $m^{-1}$ $K^{-1}$ when measured in the direction of the fiber compared to a composition not containing hBN.

Without wishing to be bound by a particular theory, it is believed that boron nitride nanomaterial (hBN, BNNS, and mixtures thereof) in the disclosed composition contributes to enhanced antibacterial properties possibly via a mechanism in which the nanosheets can physically interact against the bacterial cellular envelope, leading to irreparable damage to the bacterial cellular envelope. The damage associated with the presence of boron nitride nanomaterial can act to protect against bacterial adhesion. The disclosed composition can protect against *Escherichia coli, Pseudomonas aeruginosa, Staphylococcus epidermidis* and *Staphylococcus aureus*.

In various aspects, the disclosed compositions can further comprise plasticizers, particularly when utilized in forming films, filaments, and molded articles to enhance elasticity of the films, filaments, and molded articles comprising disclosed CNM-hBN and CNM-hBN-Alg compositions. Without wishing to be bound by a particular theory, it is believed that hydrogen bonds between water molecules and biopolymers in a disclosed composition can be decreased due to the increased affinity between water and the plasticizer, thereby increasing polymer free volume and thus reducing interchain interactions. In a further aspect, the plasticizer can include, but is not limited to, erythritol, xylitol, sorbitol, maltitol, isomalt, lactitol, hydrogenated starch hydrolysates (HSH), mannitol, fructose, inulin, arabinogalactan, glucomannan, galactooligosaccharides (GOS), xylooligosaccharides (XOS), cellulose, and glycerol. Plasticizers may also be derived from bio-based sources such as but not limited to epoxidized soybean oil, castor oil, cardanol, citrates, succinic acid, and isosorbides (Ref. 10).

In a further aspect, a film, a filament or a molded article comprising a disclosed composition can comprise a plasticizer in an amount from 0.1% to 250% based on weight of the total dry mass of the film, filament, or molded article to improve % strain from 0 to 40% strain.

In a further aspect, a film, a filament or a molded article comprising a disclosed composition can comprise a plasticizer in an amount from 0.1% to 50% based on weight of the total dry mass of the film, filament, or molded article to improve % strain from 0 to 40% strain.

In a further aspect, a film, a filament or a molded article comprising a disclosed composition can comprise a plasticizer in an amount from 0.1% to 250% based on weight of the total dry mass of the film, filament, or molded article to improve % strain from 0 to 210% strain.

In a further aspect, a film, a filament or a molded article comprising a disclosed composition can comprise a plasticizer in an amount from 0.1% to 50% based on weight of the total dry mass of the film, filament, or molded article to improve % strain from 0 to 210% strain.

In various aspects, the disclosed compositions can further comprise one or more coagulant such as an acid-based coagulant, an electrolyte coagulant, a cationic polymer, a polyol, or combinations thereof. A suitable acid-based coagulant can be a natural or synthetic mono or polycarboxylate acid, e.g., citric acid or other polycarboxylate acid, particularly a naturally occurring polycarboxylate acid. Citric acid and other acids possess at least one carboxyl groups to crosslink with hydroxyl groups via an esterification reaction. In a further aspect, one or more electrolyte coagulant can be used. In some aspects a coagulant can comprise one or more cationic polymer. A cationic polymer can be utilized to coagulate via in situ polyelectrolyte complexation. In a further aspect, a cationic polymer can comprise a natural cationic polymer such as, but not limited to, a chitosan. In a yet further aspect, a coagulant can comprise a polyol, such as ethylene glycol, glycerol, pentaerythritol, or combinations thereof. In a yet further aspect, a coagulant can comprise in situ coagulation or crosslinking comprising esterification of alginate with one or more polyol in situ using acid catalysis in which the acid catalysis is carried out using a strong acid such as HCl or sulfuric acid (e.g., see Y. Xu, et al. Material. Design (2022) 214:110424).

In a further aspect, the disclosed compositions can further comprise one or more lipid. In a still further aspect, the lipid can be provided as an emulsified lipid. In a still further aspect, a lipid can be a lipid such as, but not limited to, cottonseed oil and beeswax can be added to the disclosed composition in order create an oily phase. The resulting emulsion can be created by solution casting an emulsifier, a lipid, and the disclosed composition via heating at 70-80° C. and subsequent high shear mixing.

In a further aspect, the hydrophobicity of the disclosed CNM-hBN and CNM-hBN-ALG compositions can be modified via lipid emulsification. Lipids such as, but not limited to, cottonseed oil and beeswax can be added to the disclosed CNM-hBN and CNM-hBN-ALG compositions in order create an oily phase. This emulsion can be created by solution casting an emulsifier, a lipid, and the disclosed CNM-hBN and CNM-hBN-ALG compositions via heating at 70-80° C. and subsequent high shear mixing, e.g., preparation of the aqueous dispersion comprising a disclosed CNM-hBN and CNM-hBN-ALG composition and preparation of an oily phase comprising a lipid, followed by high-shear mixing of the aqueous dispersion with the oily phase. Without wishing to be bound by a particular theory, it is believed that by adding lipids to the composition, moisture take-up can be reduced due to its inherent hydrophobic properties.

Methods of Making Disclosed CNM-hBN and CNM-hBN-ALG Compositions

In various aspects, the disclosed methods of making the disclosed composition comprise: (a) mixing a boron nitride nanomaterial, e.g., hexagonal boron nitride, and a cellulose nanomaterial, e.g., a cellulose nanofiber material, a cellulose nanocrystal material, or combinations thereof, in water to form an aqueous solution; (b) subject the foregoing aqueous solution to milling using a suitable milling method, e.g., ball milling and/or a high shear force fluidizer, thereby forming a dispersion solution comprising exfoliated and functionalized hBN comprising boron nitride nanosheets; (c) to the dispersion solution formed in (b), adding an alginate material and mixing to form the disclosed composition as a stable solution comprising CNM, hBN/BNNS, and ALG.

Additional additives, e.g., lipids, plasticizers, colorants, and other additives as disclosed herein, can be added to the disclosed composition as a stable solution comprising CNM, hBN/BNNS, and ALG to modulate various desired properties and characteristics of the disclosed composition.

In a further aspect, the hBN can be further functionalized prior to mixing in step (a) above. In a still further aspect, the hBN/BNNS following step (c) can be further functionalized. Suitable functionalization chemistries include, but are not limited to, amino, sucrose, hydroxyl, [bmim][Tf2N], and carboxylic functionalization via organic solvents, Lewis acid bases, polysaccharides, and synthetic polymers (Refs. 12-13).

Filaments, Films, and Molded Materials

In various aspects, a disclosed composition as a stable solution comprising CNM, hBN/BNNS, and ALG can be used to make a filament, film, or a molded material.

In a further aspect, the disclosed compositions can be used to form filaments in a spinning process such as a wet spinning process. For example, in some aspects, the disclosed compositions can be formed into filaments by use of the wet spinning process comprising extrusion of the disclosed composition into a coagulation bath comprising one or more divalent cations including, but not limited, to Ca2+, Mg2+, Mn2+, Zn2+, Fe2+, Co2+, Sn2+, through a spinneret with 80 to 1000 micron holes. Without wishing to be bound by a particular theory, the G-blocks of alginate can participate in intermolecular cross-linking through exchange of its sodium ion with divalent ions. In order to form a stable fiber comprising nanocellulose and hexagonal boron nitride, filaments can be drawn through a washing bath of, but not limited to, deionized water, acetone, or ethanol in order to remove excess calcium. After washing, the filaments can then be dried under heat, e.g., radiant or convection heat, in order to collect onto a take up. Filaments drawn in this manner can have tensile strengths of from 140 mPa to 1040 mPa.

In a further aspect, electric-field assisted wet spinning processes can be utilized, e.g., used to align polymer chains by applying an alternating current voltage to improve the Young's modulus, tensile strength, yield strength, strain-at-break, and toughness. In an exemplary aspect, this can be carried out by placing the metal cathode and anode, from an arbitrary waveform and high-voltage function generator, on the wet-spinning spinneret and/or in the coagulation bath respectively. Applied voltages could range from 0.1 V to 10,000 V (Ref. 11).

In a further aspect, a disclosed composition as a stable solution comprising CNM, hBN/BNNS, and ALG, as described above and in the examples, can be used for cast or form a film. Following casting, evaporation of water can yield a desired film.

In a further aspect, a disclosed composition as a stable solution comprising CNM, hBN/BNNS, and ALG can be injected or extruded into a suitable mold to form molded articles of desired geometries, shapes, thicknesses and the like comprising a disclosed composition. In a still further aspect, the disclosed composition can be subjected to evaporative dehydration in situ in the mold using a suitable method such as radiant or convective heating.

Yarns

In various aspects, the present disclosure pertains to a yarn comprising a disclosed composition. The yarn can be a blended yarn or composite yarn comprising fibers or filaments comprising the disclosed composition and one or more additional fibers or filaments, including natural fibers and/or synthetic fibers or filaments. In a further aspect, a disclosed yarn can be flat. In a still further aspect, or other aspects, a disclosed yarn can be texturized, e.g., via a draw texturizing process.

In a further aspect, the blended yarn or composite yarn can comprise one or more additional fibers or filaments comprising a polyamide, including, but not limited to, a nylon 6, nylon 4/6, nylon 6/6, nylon 6/10, nylon 6/12, nylon 11, nylon 12, or combinations thereof. In a further aspect, the polyamide can comprise a nylon 6/6. In a still further aspect, the polyamide is a polyamide co-polymer comprising nylon 6, nylon 4/6, nylon 6/6, nylon 6/10, nylon 6/12, nylon 11, nylon 12, or combinations thereof. In a yet further aspect, the polyamide is a polyamide co-polymer comprising nylon 6/6.

In a further aspect, a disclosed yarn has a linear mass density of about 50d/20f to about 130d/90f; about 105d/20f to about 130d/40f; about 110d/20f to about 130d/40f; about 115d/20f to about 130d/40f; about 105d/20f to about 130d/35f; about 110d/35f to about 130d/35f; about 115d/20f to about 130d/35f; about 105d/20f to about 130d/30f; about 110d/20f to about 130d/30f; about 115d/20f to about 130d/30f; about 105d/20f to about 130d/40f; about 115d/25f to about 135d/35f; a sub-range within any of the foregoing ranges; or any set of values utilizing values within any of the foregoing ranges. It is understood in the foregoing values that "d" indicates Denier for the yarn and "f" indicates number of filaments in a yarn fiber. Thus, a disclosed yarn having a weight of 75d/72f would be a yarn have a linear mass density of 75 Denier with 72 filaments per yarn fiber.

In a further aspect, a disclosed yarn has a linear mass density of about 120d/20f±10%; about 120d/20f±5%; about 120d/20f±3%; 121d/20f±10%; about 121d/20f±5%; about 121d/20f±3%; 122d/20f±10%; about 122d/20f±5%; about 122d/20f±3%; 123d/20f±10%; about 123d/20f±5%; about 123d/20f±3%; 124d/20f±10%; about 124d/20f±5%; about 124d/20f±3%; 125d/20f±10%; about 125d/20f±5%; about 125d/20f±3%; 126d/20f±10%; about 126d/20f±5%; about 126d/20f±3%; 127d/20f±10%; about 127d/20f±5%; about 127d/20f±3%; 128d/20f±10%; about 128d/20f±5%; about 128d/20f±3%; 129d/20f±10%; about 129d/20f±5%; about 129d/20f±3%; 130d/20f±10%; about 130d/20f±5%; about 130d/20f±3%; about 120d/25f±10%; about 120d/25f±5%; about 120d/25f±3%; 121d/25f±10%; about 121d/25f±5%; about 121d/25f±3%; 122d/25f±10%; about 122d/25f±5%; about 122d/25f±3%; 123d/25f±10%; about 123d/25f±5%; about 123d/25f±3%; 124d/25f±10%; about 124d/25f±5%; about 124d/25f±3%; 125d/25f±10%; about 125d/25f±5%; about 125d/25f±3%; 126d/25f±10%; about 126d/25f±5%; about 126d/25f±3%; 127d/25f±10%; about 127d/25f±5%; about 127d/25f±3%; 128d/25f±10%; about 128d/25f±5%; about 128d/25f±3%; 129d/25f±10%; about 129d/25f±5%; about 129d/25f±3%; 130d/25f±10%; about 130d/25f±5%; about 130d/25f±3%; about 120d/30f±10%; about 120d/30f±5%; about 120d/30f±3%; 121d/30f±10%; about 121d/30f±5%; about 121d/30f±3%; 122d/30f±10%; about 122d/30f±5%; about 122d/30f±3%; 123d/30f±10%; about 123d/30f±5%; about 123d/30f±3%; 124d/30f±10%; about 124d/30f±5%; about 124d/30f±3%; 125d/30f±10%; about 125d/30f±5%; about 125d/30f±3%; 126d/30f±10%; about 126d/30f±5%; about 126d/30f±3%; 127d/30f±10%; about 127d/

30f±5%; about 127d/30f±3%; 128d/30f±10%; about 128d/30f±5%; about 128d/30f±3%; 129d/30f±10%; about 129d/30f±5%; about 129d/30f±3%; 130d/30f±10%; about 130d/30f±5%; about 130d/30f±3%; about 120d/35f±10%; about 120d/35f±5%; about 120d/35f±3%; 121d/35f±10%; about 121d/35f±5%; about 121d/35f±3%; 122d/35f±10%; about 122d/35f±5%; about 122d/35f±3%; 123d/35f±10%; about 123d/35f±5%; about 123d/35f±3%; 124d/35f±10%; about 124d/35f±5%; about 124d/35f±3%; 125d/35f±10%; about 125d/35f±5%; about 125d/35f±3%; 126d/35f±10%; about 126d/35f±5%; about 126d/35f±3%; 127d/35f±10%; about 127d/35f±5%; about 127d/35f±3%; 128d/35f±10%; about 128d/35f±5%; about 128d/35f±3%; 129d/35f±10%; about 129d/35f±5%; about 129d/35f±3%; 130d/35f±10%; about 130d/35f±5%; about 130d/35f±3%; about 120d/40f±10%; about 120d/40f±5%; about 120d/40f±3%; 121d/40f±10%; about 121d/40f±5%; about 121d/40f±3%; 122d/40f±10%; about 122d/40f±5%; about 122d/40f±3%; 123d/40f±10%; about 123d/40f±5%; about 123d/40f±3%; 124d/40f±10%; about 124d/40f±5%; about 124d/40f±3%; 125d/40f±10%; about 125d/40f±5%; about 125d/40f±3%; 126d/40f±10%; about 126d/40f±5%; about 126d/40f±3%; 127d/40f±10%; about 127d/40f±5%; about 127d/40f±3%; 128d/40f±10%; about 128d/40f±5%; about 128d/40f±3%; 129d/40f±10%; about 129d/40f±5%; about 129d/40f±3%; 130d/40f±10%; about 130d/40f±5%; about 130d/40f±3%; a range encompassing any of the foregoing value; or any combination of the foregoing values.

In a further aspect, a disclosed yarn has a linear mass density of about 70d/70f±10%; about 70d/70f±5%; about 70d/70f±3%; 71d/70f±10%; about 71d/70f±5%; about 71d/70f±3%; 72d/70f±10%; about 72d/70f±5%; about 72d/70f±3%; 73d/70f±10%; about 73d/70f±5%; about 73d/70f±3%; 74d/70f±10%; about 74d/70f±5%; about 74d/70f±3%; 75d/70f±10%; about 75d/70f±5%; about 75d/70f±3%; 76d/70f±10%; about 76d/70f±5%; about 76d/70f±3%; 77d/70f±10%; about 77d/70f±5%; about 77d/70f±3%; 78d/70f±10%; about 78d/70f±5%; about 78d/70f±3%; 79d/70f±10%; about 79d/70f±5%; about 79d/70f±3%; 80d/70f±10%; about 80d/70f±5%; about 80d/70f±3%; about 70d/75f±10%; about 70d/75f±5%; about 70d/75f±3%; 71d/75f±10%; about 71d/75f±5%; about 71d/75f±3%; 72d/75f±10%; about 72d/75f±5%; about 72d/75f±3%; 73d/75f±10%; about 73d/75f±5%; about 73d/75f±3%; 74d/75f±10%; about 74d/75f±5%; about 74d/75f±3%; 75d/75f±10%; about 75d/75f±5%; about 75d/75f±3%; 76d/75f±10%; about 76d/75f±5%; about 76d/75f±3%; 77d/75f±10%; about 77d/75f±5%; about 77d/75f±3%; 78d/75f±10%; about 78d/75f±5%; about 78d/75f±3%; 79d/75f±10%; about 79d/75f±5%; about 79d/75f±3%; 80d/75f±10%; about 80d/75f±5%; about 80d/75f±3%; about 70d/80f±10%; about 70d/80f±5%; about 70d/80f±3%; 71d/80f±10%; about 71d/80f±5%; about 71d/80f±3%; 72d/80f±10%; about 72d/80f±5%; about 72d/80f±3%; 73d/80f±10%; about 73d/80f±5%; about 73d/80f±3%; 74d/80f±10%; about 74d/80f±5%; about 74d/80f±3%; 75d/80f±10%; about 75d/80f±5%; about 75d/80f±3%; 76d/80f±10%; about 76d/80f±5%; about 76d/80f±3%; 77d/80f±10%; about 77d/80f±5%; about 77d/80f±3%; 78d/80f±10%; about 78d/80f±5%; about 78d/80f±3%; 79d/80f±10%; about 79d/80f±5%; about 79d/80f±3%; 80d/80f±10%; about 80d/80f±5%; about 80d/80f±3%; about 70d/85f±10%; about 70d/85f±5%; about 70d/85f±3%; 71d/85f±10%; about 71d/85f±5%; about 71d/85f±3%; 72d/85f±10%; about 72d/85f±5%; about 72d/85f±3%; 73d/85f±10%; about 73d/85f±5%; about 73d/85f±3%; 74d/85f±10%; about 74d/85f±5%; about 74d/85f±3%; 75d/85f±10%; about 75d/85f±5%; about 75d/85f±3%; 76d/85f±10%; about 76d/85f±5%; about 76d/85f±3%; 77d/85f±10%; about 77d/85f±5%; about 77d/85f±3%; 78d/85f±10%; about 78d/85f±5%; about 78d/85f±3%; 79d/85f±10%; about 79d/85f±5%; about 79d/85f±3%; 80d/85f±10%; about 80d/85f±5%; about 80d/85f±3%; about 70d/90f±10%; about 70d/90f±5%; about 70d/90f±3%; 71d/90f±10%; about 71d/90f±5%; about 71d/90f±3%; 72d/90f±10%; about 72d/90f±5%; about 72d/90f±3%; 73d/90f±10%; about 73d/90f±5%; about 73d/90f±3%; 74d/90f±10%; about 74d/90f±5%; about 74d/90f±3%; 75d/90f±10%; about 75d/90f±5%; about 75d/90f±3%; 76d/90f±10%; about 76d/90f±5%; about 76d/90f±3%; 77d/90f±10%; about 77d/90f±5%; about 77d/90f±3%; 78d/90f±10%; about 78d/90f±5%; about 78d/90f±3%; 79d/90f±10%; about 79d/90f±5%; about 79d/90f±3%; 80d/90f±10%; about 80d/90f±5%; about 80d/90f±3%; a range encompassing any of the foregoing value; or any combination of the foregoing values.

In various aspects, a disclosed yarn has a linear mass density of about 250 Denier to about 370 Denier; about 260 Denier to about 370 Denier; about 270 Denier to about 370 Denier; about 280 Denier to about 370 Denier; about 290 Denier to about 370 Denier; about 300 Denier to about 370 Denier; about 310 Denier to about 370 Denier; about 320 Denier to about 370 Denier; about 330 Denier to about 370 Denier; about 340 Denier to about 370 Denier; about 350 Denier to about 370 Denier; about 355 Denier to about 370 Denier; about 360 Denier to about 370 Denier; about 250 Denier to about 360 Denier; about 260 Denier to about 360 Denier; about 270 Denier to about 360 Denier; about 280 Denier to about 360 Denier; about 290 Denier to about 360 Denier; about 300 Denier to about 360 Denier; about 310 Denier to about 360 Denier; about 320 Denier to about 360 Denier; about 330 Denier to about 360 Denier; about 340 Denier to about 360 Denier; about 350 Denier to about 360 Denier; about 250 Denier to about 350 Denier; about 260 Denier to about 350 Denier; about 270 Denier to about 350 Denier; about 280 Denier to about 350 Denier; about 290 Denier to about 350 Denier; about 300 Denier to about 350 Denier; about 310 Denier to about 350 Denier; about 320 Denier to about 350 Denier; about 330 Denier to about 350 Denier; about 340 Denier to about 350 Denier; about 250 Denier to about 340 Denier; about 260 Denier to about 340 Denier; about 270 Denier to about 340 Denier; about 280 Denier to about 340 Denier; about 290 Denier to about 340 Denier; about 300 Denier to about 340 Denier; about 310 Denier to about 340 Denier; about 320 Denier to about 340 Denier; about 330 Denier to about 340 Denier; about 250 Denier to about 330 Denier; about 260 Denier to about 330 Denier; about 270 Denier to about 330 Denier; about 280 Denier to about 330 Denier; about 285 Denier to about 330 Denier; about 290 Denier to about 330 Denier; about 300 Denier to about 330 Denier; about 310 Denier to about 330 Denier; about 320 Denier to about 330 Denier; about 250 Denier to about 320 Denier; about 260 Denier to about 320 Denier; about 270 Denier to about 320 Denier; about 280 Denier to about 320 Denier; about 290 Denier to about 320 Denier; about 300 Denier to about 320 Denier; about 310 Denier to about 320 Denier; about 250 Denier to about 310 Denier; about 260 Denier to about 310 Denier; about 270 Denier to about 310 Denier; about 280 Denier to about 310 Denier; about 290 Denier to about 310 Denier; about 300 Denier to about 310 Denier; about 250 Denier to about 300 Denier; about 260 Denier to about 300 Denier; about 270 Denier to about 300 Denier; about 280 Denier to about 300 Denier; about 290 Denier to about 300 Denier; about 250

Denier to about 350 Denier; about 270 Denier to about 330 Denier; about 280 Denier to about 320 Denier; about 285 Denier to about 310 Denier; about 250 Denier to about 360 Denier; about 270 Denier to about 360 Denier; about 280 Denier to about 360 Denier; about 285 Denier to about 360 Denier; a sub-range within any of the foregoing ranges; or any set of values utilizing values within any of the foregoing ranges.

In a further aspect, a disclosed yarn has a linear mass density of about 270 Denier±10%; 270 Denier±5%; about 270 Denier±3%; about 271 Denier±10%; 271 Denier±5%; about 271 Denier±3%; about 272 Denier±10%; 272 Denier±5%; about 272 Denier±3%; about 273 Denier±10%; 273 Denier±5%; about 273 Denier±3%; about 274 Denier±10%; 274 Denier±5%; about 274 Denier±3%; about 275 Denier±10%; 275 Denier±5%; about 275 Denier±3%; about 276 Denier±10%; 276 Denier±5%; about 276 Denier±3%; about 277 Denier±10%; 277 Denier±5%; about 277 Denier±3%; about 278 Denier±10%; 278 Denier±5%; about 278 Denier±3%; about 279 Denier±10%; 279 Denier±5%; about 279 Denier±3%; about 280 Denier±10%; 280 Denier±5%; about 280 Denier±3%; about 281 Denier±10%; 281 Denier±5%; about 281 Denier±3%; about 282 Denier±10%; 282 Denier±5%; about 282 Denier±3%; about 283 Denier±10%; 283 Denier±5%; about 283 Denier±3%; about 284 Denier±10%; 284 Denier±5%; about 284 Denier±3%; about 285 Denier±10%; 285 Denier±5%; about 285 Denier±3%; about 286 Denier±10%; 286 Denier±5%; about 286 Denier±3%; about 287 Denier±10%; 287 Denier±5%; about 287 Denier±3%; about 288 Denier±10%; 288 Denier±5%; about 288 Denier±3%; about 289 Denier±10%; 289 Denier±5%; about 289 Denier±3%; about 290 Denier±10%; 290 Denier±5%; about 290 Denier±3%; about 291 Denier±10%; 291 Denier±5%; about 291 Denier±3%; about 292 Denier±10%; 292 Denier±5%; about 292 Denier±3%; about 293 Denier±10%; 293 Denier±5%; about 293 Denier±3%; about 294 Denier±10%; 294 Denier±5%; about 294 Denier±3%; about 295 Denier±10%; 295 Denier±5%; about 295 Denier±3%; about 296 Denier±10%; 296 Denier±5%; about 296 Denier±3%; about 297 Denier±10%; 297 Denier±5%; about 297 Denier±3%; about 298 Denier±10%; 298 Denier±5%; about 298 Denier±3%; about 299 Denier±10%; 299 Denier±5%; about 299 Denier±3%; about 300 Denier±10%; 300 Denier±5%; about 300 Denier±3%; about 301 Denier±10%; 301 Denier±5%; about 301 Denier±3%; about 302 Denier±10%; 302 Denier±5%; about 302 Denier±3%; about 303 Denier±10%; 303 Denier±5%; about 303 Denier±3%; about 304 Denier±10%; 304 Denier±5%; about 304 Denier±3%; about 305 Denier±10%; 305 Denier±5%; about 305 Denier±3%; about 306 Denier±10%; 306 Denier±5%; about 306 Denier±3%; about 307 Denier±10%; 307 Denier±5%; about 307 Denier±3%; about 308 Denier±10%; 308 Denier±5%; about 308 Denier±3%; about 309 Denier±10%; 309 Denier±5%; about 309 Denier±3%; about 310 Denier±10%; 310 Denier±5%; about 310 Denier±3%; about 311 Denier±10%; 311 Denier±5%; about 311 Denier±3%; about 312 Denier±10%; 312 Denier±5%; about 312 Denier±3%; about 313 Denier±10%; 313 Denier±5%; about 313 Denier±3%; about 314 Denier±10%; 314 Denier±5%; about 314 Denier±3%; about 315 Denier±10%; 315 Denier±5%; about 315 Denier±3%; about 316 Denier±10%; 316 Denier±5%; about 316 Denier±3%; about 317 Denier±10%; 317 Denier±5%; about 317 Denier±3%; about 318 Denier±10%; 318 Denier±5%; about 318 Denier±3%; about 319 Denier±10%; 319 Denier±5%; about 319 Denier±3%; about 320 Denier±10%; 320 Denier±5%; about 320 Denier±3%; about 321 Denier±10%; 321 Denier±5%; about 321 Denier±3%; about 322 Denier±10%; 322 Denier±5%; about 322 Denier±3%; about 323 Denier±10%; 323 Denier±5%; about 323 Denier±3%; about 324 Denier±10%; 324 Denier±5%; about 324 Denier±3%; about 325 Denier±10%; 325 Denier±5%; about 325 Denier±3%; about 326 Denier±10%; 326 Denier±5%; about 326 Denier±3%; about 327 Denier±10%; 327 Denier±5%; about 327 Denier±3%; about 328 Denier±10%; 328 Denier±5%; about 328 Denier±3%; about 329 Denier±10%; 329 Denier±5%; about 329 Denier±3%; about 330 Denier±10%; 330 Denier±5%; about 330 Denier±3%; about 331 Denier±10%; 331 Denier±5%; about 331 Denier±3%; about 332 Denier±10%; 332 Denier±5%; about 332 Denier±3%; about 333 Denier±10%; 333 Denier±5%; about 333 Denier±3%; about 334 Denier±10%; 334 Denier±5%; about 334 Denier±3%; about 335 Denier±10%; 335 Denier±5%; about 335 Denier±3%; about 336 Denier±10%; 336 Denier±5%; about 336 Denier±3%; about 337 Denier±10%; 337 Denier±5%; about 337 Denier±3%; about 338 Denier±10%; 338 Denier±5%; about 338 Denier±3%; about 339 Denier±10%; 339 Denier±5%; about 339 Denier±3%; about 340 Denier±10%; 340 Denier±5%; about 340 Denier±3%; about 341 Denier±10%; 341 Denier±5%; about 341 Denier±3%; about 342 Denier±10%; 342 Denier±5%; about 342 Denier±3%; about 343 Denier±10%; 343 Denier±5%; about 343 Denier±3%; about 344 Denier±10%; 344 Denier±5%; about 344 Denier±3%; about 345 Denier±10%; 345 Denier±5%; about 345 Denier±3%; about 346 Denier±10%; 346 Denier±5%; about 346 Denier±3%; about 347 Denier±10%; 347 Denier±5%; about 347 Denier±3%; about 348 Denier±10%; 348 Denier±5%; about 348 Denier±3%; about 349 Denier±10%; 349 Denier±5%; about 349 Denier±3%; about 350 Denier±10%; 350 Denier±5%; about 350 Denier±3%; about 351 Denier±10%; 351 Denier±5%; about 351 Denier±3%; about 352 Denier±10%; 352 Denier±5%; about 352 Denier±3%; about 353 Denier±10%; 353 Denier±5%; about 353 Denier±3%; about 354 Denier±10%; 354 Denier±5%; about 354 Denier±3%; about 355 Denier±10%; 355 Denier±5%; about 355 Denier±3%; about 356 Denier±10%; 356 Denier±5%; about 356 Denier±3%; about 357 Denier±10%; 357 Denier±5%; about 357 Denier±3%; about 358 Denier±10%; 358 Denier±5%; about 358 Denier±3%; about 359 Denier±10%; 359 Denier±5%; about 359 Denier±3%; about 360 Denier±10%; 360 Denier±5%; about 360 Denier±3%; about 361 Denier±10%; 361 Denier±5%; about 361 Denier±3%; about 362 Denier±10%; 362 Denier±5%; about 362 Denier±3%; about 363 Denier±10%; 363 Denier±5%; about 363 Denier±3%; about 364 Denier±10%; 364 Denier±5%; about 364 Denier±3%; about 365 Denier±10%; 365 Denier±5%; about 365 Denier±3%; about 366 Denier±10%; 366 Denier±5%; about 366 Denier±3%; about 367 Denier±10%; 367 Denier±5%; about 367 Denier±3%; about 368 Denier±10%; 368 Denier±5%; about 368 Denier±3%; about 369 Denier±10%; about 369 Denier±5%; about 369 Denier±3%; about 370 Denier±10%; 370 Denier±5%; about 370 Denier±3%; about 371 Denier±10%; 371 Denier±5%; about 371 Denier±3%; about 372 Denier±10%; 372 Denier±5%; about 372 Denier±3%; about 373 Denier±10%; 373 Denier±5%; about 373 Denier±3%; about 374 Denier±10%; 374 Denier±5%; about 374 Denier±3%; about 375 Denier±10%; 375 Denier±5%; about 375 Denier±3%; about 376 Denier±10%; 376 Denier±5%; about 376 Denier±3%; about 377 Denier±10%; 377 Denier±5%; about 377 Denier±3%; about 378 Denier±10%; 378 Denier±5%; about 378 Denier±3%; about 379 Denier±10%; about 379 Denier±5%; about 379 Denier±3%; about 380 Denier±10%; about 380 Denier±5%; about 380 Denier±3%; a range encompassing any of the foregoing values; or any combination of the foregoing values.

In various aspects, a disclosed yarn has a linear mass density of about 50 Denier to about 170 Denier; about 60 Denier to about 170 Denier; about 70 Denier to about 170 Denier; about 80 Denier to about 170 Denier; about 90 Denier to about 170 Denier; about 100 Denier to about 170 Denier; about 110 Denier to about 170 Denier; about 120 Denier to about 170 Denier; about 130 Denier to about 170 Denier; about 140 Denier to about 170 Denier; about 150 Denier to about 170 Denier; about 155 Denier to about 170 Denier; about 160 Denier to about 170 Denier; about 50 Denier to about 160 Denier; about 60 Denier to about 160 Denier; about 70 Denier to about 160 Denier; about 80 Denier to about 160 Denier; about 90 Denier to about 160 Denier; about 100 Denier to about 160 Denier; about 110 Denier to about 160 Denier; about 120 Denier to about 160 Denier; about 130 Denier to about 160 Denier; about 140 Denier to about 160 Denier; about 150 Denier to about 160 Denier; about 50 Denier to about 150 Denier; about 60 Denier to about 150 Denier; about 70 Denier to about 150 Denier; about 80 Denier to about 150 Denier; about 90 Denier to about 150 Denier; about 100 Denier to about 150 Denier; about 110 Denier to about 150 Denier; about 120 Denier to about 150 Denier; about 130 Denier to about 150 Denier; about 140 Denier to about 150 Denier; about 50 Denier to about 140 Denier; about 60 Denier to about 140 Denier; about 70 Denier to about 140 Denier; about 80 Denier to about 140 Denier; about 90 Denier to about 140 Denier; about 100 Denier to about 140 Denier; about 110 Denier to about 140 Denier; about 120 Denier to about 140 Denier; about 130 Denier to about 140 Denier; about 50 Denier to about 130 Denier; about 60 Denier to about 130 Denier; about 70 Denier to about 130 Denier; about 80 Denier to about 130 Denier; about 85 Denier to about 130 Denier; about 90 Denier to about 130 Denier; about 100 Denier to about 130 Denier; about 110 Denier to about 130 Denier; about 120 Denier to about 130 Denier; about 50 Denier to about 120 Denier; about 60 Denier to about 120 Denier; about 70 Denier to about 120 Denier; about 80 Denier to about 120 Denier; about 90 Denier to about 120 Denier; about 100 Denier to about 120 Denier; about 110 Denier to about 120 Denier; about 50 Denier to about 110 Denier; about 60 Denier to about 110 Denier; about 70 Denier to about 110 Denier; about 80 Denier to about 110 Denier; about 90 Denier to about 110 Denier; about 100 Denier to about 110 Denier; about 50 Denier to about 100 Denier; about 60 Denier to about 100 Denier; about 70 Denier to about 100 Denier; about 80 Denier to about 100 Denier; about 90 Denier to about 100 Denier; about 50 Denier to about 150 Denier; about 70 Denier to about 130 Denier; about 80 Denier to about 120 Denier; about 85 Denier to about 110 Denier; about 50 Denier to about 160 Denier; about 70 Denier to about 160 Denier; about 80 Denier to about 160 Denier; about 85 Denier to about 160 Denier; a sub-range within any of the foregoing ranges; or any set of values utilizing values within any of the foregoing ranges.

In a further aspect, a disclosed yarn has a linear mass density of about 70 Denier±10%; 270 Denier±5%; about 70 Denier±3%; about 71 Denier±10%; 271 Denier±5%; about 71 Denier±3%; about 72 Denier±10%; 272 Denier±5%; about 72 Denier±3%; about 73 Denier±10%; 273 Denier±5%; about 73 Denier±3%; about 74 Denier±10%; 274 Denier±5%; about 74 Denier±3%; about 75 Denier±10%; 275 Denier±5%; about 75 Denier±3%; about 76 Denier±10%; 276 Denier±5%; about 76 Denier±3%; about 77 Denier±10%; 277 Denier±5%; about 77 Denier±3%; about 78 Denier±10%; 278 Denier±5%; about 78 Denier±3%; about 79 Denier±10%; 279 Denier±5%; about 79 Denier±3%; about 80 Denier±10%; 280 Denier±5%; about 80 Denier±3%; about 81 Denier±10%; 281 Denier±5%; about 81 Denier±3%; about 82 Denier±10%; 282 Denier±5%; about 82 Denier±3%; about 83 Denier±10%; 283 Denier±5%; about 83 Denier±3%; about 84 Denier±10%; 284 Denier±5%; about 84 Denier±3%; about 85 Denier±10%; 285 Denier±5%; about 85 Denier±3%; about 86 Denier±10%; 286 Denier±5%; about 86 Denier±3%; about 87 Denier±10%; 287 Denier±5%; about 87 Denier±3%; about 88 Denier±10%; 288 Denier±5%; about 88 Denier±3%; about 89 Denier±10%; 289 Denier±5%; about 89 Denier±3%; about 90 Denier±10%; 290 Denier±5%; about 90 Denier±3%; about 91 Denier±10%; 291 Denier±5%; about 91 Denier±3%; about 92 Denier±10%; 292 Denier±5%; about 92 Denier±3%; about 93 Denier±10%; 293 Denier±5%; about 93 Denier±3%; about 94 Denier±10%; 294 Denier±5%; about 94 Denier±3%; about 95 Denier±10%; 295 Denier±5%; about 95 Denier±3%; about 96 Denier±10%; 296 Denier±5%; about 96 Denier±3%; about 97 Denier±10%; 297 Denier±5%; about 97 Denier±3%; about 98 Denier±10%; 298 Denier±5%; about 98 Denier±3%; about 99 Denier±10%; 299 Denier±5%; about 99 Denier±3%; about 100 Denier±10%; 300 Denier±5%; about 100 Denier±3%; about 101 Denier±10%; 301 Denier±5%; about 101 Denier±3%; about 102 Denier±10%; 302 Denier±5%; about 102 Denier±3%; about 103 Denier±10%; 303 Denier±5%; about 103 Denier±3%; about 104 Denier±10%; 304 Denier±5%; about 104 Denier±3%; about 105 Denier±10%; 305 Denier±5%; about 105 Denier±3%; about 106 Denier±10%; 306 Denier±5%; about 106 Denier±3%; about 107 Denier±10%; 307 Denier±5%; about 107 Denier±3%; about 108 Denier±10%; 308 Denier±5%; about 108 Denier±3%; about 109 Denier±10%; 309 Denier±5%; about 109 Denier±3%; about 110 Denier±10%; 310 Denier±5%; about 110 Denier±3%; about 111 Denier±10%; 311 Denier±5%; about 111 Denier±3%; about 112 Denier±10%; 312 Denier±5%; about 112 Denier±3%; about 113 Denier±10%; 313 Denier±5%; about 113 Denier±3%; about 114 Denier±10%; 314 Denier±5%; about 114 Denier±3%; about 115 Denier±10%; 315 Denier±5%; about 115 Denier±3%; about 116 Denier±10%; 316 Denier±5%; about 116 Denier±3%; about 117 Denier±10%; 317 Denier±5%; about 117 Denier±3%; about 118 Denier±10%; 318 Denier±5%; about 118 Denier±3%; about 119 Denier±10%; 319 Denier±5%; about 119 Denier±3%; about 120 Denier±10%; 320 Denier±5%; about 120 Denier±3%; about 121 Denier±10%; 321 Denier±5%; about 121 Denier±3%; about 122 Denier±10%; 322 Denier±5%; about 122 Denier±3%; about 123 Denier±10%; 323 Denier±5%; about 123 Denier±3%; about 124 Denier±10%; 324 Denier±5%; about 124 Denier±3%; about 125 Denier±10%; 325 Denier±5%; about 125 Denier±3%; about 126 Denier±10%; 326 Denier±5%; about 126 Denier±3%; about 127 Denier±10%; 327 Denier±5%; about 127 Denier±3%; about 128 Denier±10%; 328 Denier±5%; about 128 Denier±3%; about 129 Denier±10%; 329 Denier±5%; about 129 Denier±3%; about 130 Denier±10%; 330 Denier±5%; about 130 Denier±3%; about 131 Denier±10%; 331 Denier±5%; about 131 Denier±3%; about 132 Denier±10%; 332 Denier±5%; about 132 Denier±3%;

about 133 Denier±10%; 333 Denier±5%; about 133 Denier±3%; about 134 Denier±10%; 334 Denier±5%; about 134 Denier±3%; about 135 Denier±10%; 335 Denier±5%; about 135 Denier±3%; about 136 Denier±10%; 336 Denier±5%; about 136 Denier±3%; about 137 Denier±10%; 337 Denier±5%; about 137 Denier±3%; about 138 Denier±10%; 338 Denier±5%; about 138 Denier±3%; about 139 Denier±10%; 339 Denier±5%; about 139 Denier±3%; about 140 Denier±10%; 340 Denier±5%; about 140 Denier±3%; about 141 Denier±10%; 341 Denier±5%; about 141 Denier±3%; about 142 Denier±10%; 342 Denier±5%; about 142 Denier±3%; about 143 Denier±10%; 343 Denier±5%; about 143 Denier±3%; about 144 Denier±10%; 344 Denier±5%; about 144 Denier±3%; about 145 Denier±10%; 345 Denier±5%; about 145 Denier±3%; about 146 Denier±10%; 346 Denier±5%; about 146 Denier±3%; about 147 Denier±10%; 347 Denier±5%; about 147 Denier±3%; about 148 Denier±10%; 348 Denier±5%; about 148 Denier±3%; about 149 Denier±10%; 349 Denier±5%; about 149 Denier±3%; about 150 Denier±10%; 350 Denier±5%; about 150 Denier±3%; about 151 Denier±10%; 351 Denier±5%; about 151 Denier±3%; about 152 Denier±10%; 352 Denier±5%; about 152 Denier±3%; about 153 Denier±10%; 353 Denier±5%; about 153 Denier±3%; about 154 Denier±10%; 354 Denier±5%; about 154 Denier±3%; about 155 Denier±10%; 355 Denier±5%; about 155 Denier±3%; about 156 Denier±10%; 356 Denier±5%; about 156 Denier±3%; about 157 Denier±10%; 357 Denier±5%; about 157 Denier±3%; about 158 Denier±10%; 358 Denier±5%; about 158 Denier±3%; about 159 Denier±10%; 359 Denier±5%; about 159 Denier±3%; about 160 Denier±10%; 360 Denier±5%; about 160 Denier±3%; about 161 Denier±10%; 361 Denier±5%; about 161 Denier±3%; about 162 Denier±10%; 362 Denier±5%; about 162 Denier±3%; about 163 Denier±10%; 363 Denier±5%; about 163 Denier±3%; about 164 Denier±10%; 364 Denier±5%; about 164 Denier±3%; about 165 Denier±10%; 365 Denier±5%; about 165 Denier±3%; about 166 Denier±10%; 366 Denier±5%; about 166 Denier±3%; about 167 Denier±10%; 367 Denier±5%; about 167 Denier±3%; about 168 Denier±10%; 368 Denier±5%; about 168 Denier±3%; about 169 Denier±10%; about 169 Denier±5%; about 169 Denier±3%; about 170 Denier±10%; 370 Denier±5%; about 170 Denier±3%; about 171 Denier±10%; 371 Denier±5%; about 171 Denier±3%; about 172 Denier±10%; 372 Denier±5%; about 172 Denier±3%; about 173 Denier±10%; 373 Denier±5%; about 173 Denier±3%; about 174 Denier±10%; 374 Denier±5%; about 174 Denier±3%; about 175 Denier±10%; 375 Denier±5%; about 175 Denier±3%; about 176 Denier±10%; 376 Denier±5%; about 176 Denier±3%; about 177 Denier±10%; 377 Denier±5%; about 177 Denier±3%; about 178 Denier±10%; 378 Denier±5%; about 178 Denier±3%; about 179 Denier±10%; about 179 Denier±5%; about 179 Denier±3%; about 180 Denier±10%; about 180 Denier±5%; about 180 Denier±3%; a range encompassing any of the foregoing values; or any combination of the foregoing values.

The disclosed yarns and/or filaments can be used to manufacture a fabric. In a further aspect, the fabric can be woven fabric. In a still further aspect, the fabric can be non-woven fabric. In a yet further aspect, the fabric can be a knitted fabric.

Artificial Leather Materials

In various aspects, the disclosed compositions can be utilized for form an artificial leather material. The artificial leather can comprise composite materials, e.g., a disclosed composition can be formed onto a fibrous backing as described herein.

An artificial leather material can be prepared using the disclosed methods of making a disclosed composition and further comprising molding the composition. Molding can be carried out with a fibrous backing such as a fibrous woven backing comprising cotton, wool, or other materials. The use of a fibrous backing in the molding process can further impart the artificial leather material with tear resistance. In some instances, the molds comprise vents to provide enhanced evaporation of water from the mold. Evaporation of water from a disclosed composition can be carried using a convection dehydrator as known to the skilled artisan, e.g., at about 30-40° C. for a period of from about 6 hours to about 96 hours. In some instances, the evaporative time can be from about 18 hours to about 30 hours.

In a further aspect, the artificial leather can be chemically crosslinked. The chemical crosslinking can be carried out in a solution, such as an aqueous solution, of a CNM-hBN composition or CNM-hBN-SA composition prior to dehydration. Alternatively, the chemical cross-linking can be carried out in situ on the artificial leather material after dehydration. In an exemplary aspect, the chemical cross-linking comprises use of a divalent cation material, e.g., calcium chloride and/or magnesium chloride.

Articles

In one aspect, the disclosure relates to articles comprising a disclosed composition, a disclosed filament, a disclosed yarn, a disclosed fabric, and/or a disclosed artificial leather. In a further aspect, the article is an article of clothing, including, but not limited to a pair of pants, a shirt, a jacket, a dress, a glove, a skirt, T-shirt, vest, poly top, pullover, male or female brief, underwear, long-john, nightwear such as pajamas, intimate apparel, bra, cardigan, skit, dress, blouse, trousers, tracksuit bottom, shorts, sock, tie, pair of jeans, pair of gloves, coat, jacket, mitt, hat, cap, skull cap, helmet, dressing gown, baby clothing, garments such as gowns, drapes, overalls, masks, uniforms such as chefs jackets and aprons, and an inner lining of clothing and towels. In a still further aspect, the article comprising the disclosed composition is an article of sportswear. Clothing includes footwear, for example, insoles, shoes, sandals and trainers. The fabric comprising the disclosed yarns and fabrics can constitute part of or, preferably, all of a garment fabric. For instance, it is possible to construct trousers, shirts, t-shirts where the fabric of each was the fabric of the present disclosure. Alternatively, only part of a garment may comprise the fabric of the present disclosure. For example, a garment such as a t-shirt or shirt, may comprise the fabric of the present disclosure in locations commonly associate with greater heating and/or generation of moisture, such as the 'armpits' or back of the garment.

In a further aspect, the article is an article of drapery, home textile, home furnishing, upholstery cover, mattress pad, mattress cover, mattress ticking, blanket, bed linen, table linen, sheet, duvet cover, throw, sleeping bag, or combinations of the foregoing articles. An article in the form of upholstery covers, includes, but is not limited to, upholstery covers for furniture for home, institutional and commercial markets, and for transportation seating. In a still further aspect, the article comprising the disclosed composition a floor covering. In a yet further aspect, the article comprising the disclosed composition is a tote bag, a furniture cover, a tarpaulin, or a vehicle seat.

In one aspect, the disclosure relates to articles such as is an article of clothing, including, but not limited to a pair of pants, a shirt, a jacket, a dress, a glove, a skirt, T-shirt, vest, poly top, pullover, male or female brief, underwear, long-john, nightwear such as pajamas, bra, cardigan, skit, dress, blouse, trousers, tracksuit bottom, shorts, sock, tie, pair of jeans, pair of gloves, coat, jacket, mitt, hat, cap, skull cap, helmet, dressing gown, baby clothing, garments such as gowns, drapes, overalls, masks, uniforms such as chefs jackets and aprons, and an inner lining of clothing and towels. In a still further aspect, the article comprising the disclosed cooling filament yarn an article of sportswear. Clothing includes footwear, for example, insoles, shoes, sandals and trainers. The fabric comprising the disclosed yarns and fabrics can constitute part of or, preferably, all of a garment fabric. For instance, it is possible to construct trousers, shirts, t-shirts where the fabric of each was the fabric of the present disclosure. Alternatively, only part of a garment may comprise the fabric of the present disclosure. For example, a garment such as a t-shirt or shirt, may comprise the fabric of the present disclosure in locations commonly associate with greater heating and/or generation of moisture, such as the 'armpits' or back of the garment.

In a further aspect, the article can be an article of drapery, home textile, home furnishing, upholstery cover, mattress pad, mattress cover, mattress ticking, blanket, bed linen, table linen, sheet, duvet cover, throw, sleeping bag, or combinations of the foregoing articles. An article in the form of upholstery covers, includes, but is not limited to, upholstery covers for furniture for home, institutional and commercial markets, and for transportation seating. In a still further aspect, the article is a floor covering. In a yet further aspect, the article is a handbag, a tote bag, a furniture cover, a tarpaulin, or a vehicle seat.

In one aspect, the disclosure relates to articles comprising a disclosed fabric. In a further aspect, the article comprising the disclosed fabric is an article of clothing, including, but not limited to a pair of pants, a shirt, a jacket, a dress, a glove, a skirt, T-shirt, vest, poly top, pullover, male or female brief, underwear, long-john, nightwear such as pajamas, bra, cardigan, skit, dress, blouse, trousers, tracksuit bottom, shorts, sock, tie, pair of jeans, pair of gloves, coat, jacket, boxing glove, mitt, hat, cap, skull cap, helmet, dressing gown, baby clothing, garments such as gowns, drapes, overalls, masks, uniforms such as chefs jackets and aprons, and an inner lining of clothing and towels. In a still further aspect, the article comprising the disclosed fabric an article of sportswear. Clothing includes footwear, for example, insoles, shoes, sandals and trainers. The fabric comprising the disclosed yarns and fabrics can constitute part of or, preferably, all of a garment fabric. For instance, it is possible to construct trousers, shirts, t-shirts where the fabric of each was the fabric of the present disclosure. Alternatively, only part of a garment may comprise the fabric of the present disclosure. For example, a garment such as a t-shirt or shirt, may comprise the fabric of the present disclosure in locations commonly associate with greater heating and/or generation of moisture, such as the 'armpits' or back of the garment.

In a further aspect, the article comprising the disclosed fabric an article of drapery, home textile, home furnishing, upholstery cover, mattress pad, mattress cover, mattress ticking, blanket, bed linen, table linen, sheet, duvet cover, throw, sleeping bag, or combinations of the foregoing articles. An article in the form of upholstery covers, includes, but is not limited to, upholstery covers for furniture for home, institutional and commercial markets, and for transportation seating. In a still further aspect, the article comprising the disclosed fabric a floor covering. In a yet further aspect, the article comprising the disclosed fabric is a tote bag, a furniture cover, a tarpaulin, or a vehicle seat.

In a further aspect, the articles are a technical textile comprising a disclosed composition, a disclosed filament, a disclosed yarn, and/or a disclosed fabric such as athleticwear, outwear, and protective clothing.

REFERENCES

References are cited herein throughout using the format of reference number(s) enclosed by parentheses corresponding to one or more of the following numbered references. For example, citation of references numbers 1 and 2 immediately herein below would be indicated in the disclosure as (Refs. 1 and 2).

Ref 1: K. Dhali, et al., Sci. Tot. Environ. (2021) 775:145871.
Ref 2: M. H. Godinho, et al., Materials (2014) 7(6):4601-4627.
Ref 3: K. Y. Lee and D. J. Mooney, Prog. Poly. Sci. (2012) 37(1): 106-12.
Ref 4: Y. Li, et al., Nano Energy (2015) 13:346-354.
Ref. 5: P. Siqueira, et al., Nanomaterials (2019) 9(1):78.
Ref 6: J. Huang, et al., ACS Appl. Nano Mater. 2021, 4, 13167-13175.
Ref. 7: S. Pandit, et al., RSC Adv. (2019) 9:33454-33459.
Ref 8: L. C. Paixao, et al., J. Appl. Poly. Sci. (2019) 48:48263.
Ref 9: C. Gao, et al., Food Hydrocolloids (2017) 63:414-420.
Ref 10: A. Alhanish and M. A. Ghalia, Biotech. Prog. (2021) 37(6):e3210.
Ref 11: P. S. Panicker, et al. Cellulose (2022) 29:3499-3511.
Ref 12: H. Jiang, et al., ACS Appl. Mater. Interfaces (2021) 13(37):44751-44759
Ref 13: X. Tian, et al., Chem. Eng. J. (2021) 408:127360.
Ref. 14: W. Prus-Walendzia, et al., Materials (2021) 14:745.

Aspects

The following listing of exemplary aspects supports and is supported by the disclosure provided herein.

Aspect 1. A composition comprising a boron nitride nanomaterial and a cellulose nanomaterial.

Aspect 2. The composition of Aspect 1, wherein the boron nitride nanomaterial comprises exfoliated boron nitride.

Aspect 3. The composition of Aspect 2, wherein the exfoliated boron nitride nanomaterial comprises boron nitride nanosheets.

Aspect 4. The composition of Aspect 3, wherein the boron nitride nanosheets have an average thickness of from about 1 nm to about 50 nm.

Aspect 5. The composition of Aspect 4, wherein the boron nitride nanosheets have an average thickness of from about 5 nm to about 30 nm.

Aspect 6. The composition of Aspect 4, wherein the boron nitride nanosheets have an average thickness of from about 5 nm to about 15 nm.

Aspect 7. The composition of Aspect 4, wherein the boron nitride nanosheets have an average thickness of from about 7.5 nm to about 12.5 nm.

Aspect 8. The composition of any one of Aspects 1-7, wherein the cellulose nanomaterial comprises cellulose nanofibers, cellulose nanocrystals, or combinations thereof.

Aspect 9. The composition of Aspect 8, wherein the cellulose nanomaterial comprises cellulose nanofibers having an average diameter of less than about 500 nm.

Aspect 10. The composition of Aspect 8, wherein the cellulose nanomaterial comprises cellulose nanofibers having an average diameter of less than about 250 nm.

Aspect 11. The composition of Aspect 8, wherein the cellulose nanomaterial comprises cellulose nanofibers having an average diameter of less than about 150 nm.

Aspect 12. The composition of Aspect 8, wherein the cellulose nanomaterial comprises cellulose nanofibers having an average diameter of less than about 100 nm.

Aspect 13. The composition of Aspect 8, wherein the cellulose nanomaterial comprises cellulose nanofibers having an average diameter of less than about 50 nm.

Aspect 14. The composition of Aspect 8, wherein the cellulose nanomaterial comprises cellulose nanocrystals having an average particle size of less than about 500 nm in the longest dimension.

Aspect 15. The composition of Aspect 8, wherein the cellulose nanomaterial comprises cellulose nanocrystals having an average particle size of less than about 250 nm in the longest dimension.

Aspect 16. The composition of Aspect 8, wherein the cellulose nanomaterial comprises cellulose nanocrystals having an average particle size of less than about 150 nm in the longest dimension.

Aspect 17. The composition of Aspect 8, wherein the cellulose nanomaterial comprises cellulose nanocrystals having an average particle size of less than about 100 nm in the longest dimension.

Aspect 18. The composition of Aspect 8, wherein the cellulose nanomaterial comprises cellulose nanocrystals having an average particle size of less than about 50 nm in the longest dimension.

Aspect 19. The composition of any one of Aspects 1-18, wherein the boron nitride nanomaterial and the cellulose nanomaterial are present in a weight ration of from about 10:1 to about 1:10.

Aspect 20. The composition of Aspect 19, wherein the boron nitride nanomaterial and the cellulose nanomaterial are present in a weight ration of from about 5:1 to about 1:5.

Aspect 21. The composition of Aspect 19, wherein the boron nitride nanomaterial and the cellulose nanomaterial are present in a weight ration of from about 3:1 to about 1:3.

Aspect 22. The composition of Aspect 19, wherein the boron nitride nanomaterial and the cellulose nanomaterial are present in a weight ration of from about 2:1 to about 1:2.

Aspect 23. The composition of Aspect 19, wherein the boron nitride nanomaterial and the cellulose nanomaterial are present in a weight ration of from about 1.5:1 to about 1:1.5.

Aspect 24. The composition of Aspect 19, wherein the boron nitride nanomaterial and the cellulose nanomaterial are present in a weight ration of from about 1.2:1 to about 1:1.2.

Aspect 25. The composition of Aspect 19, wherein the boron nitride nanomaterial and the cellulose nanomaterial are present in a weight ration of from about 1.1:1 to about 1:1.1.

Aspect 26. The composition of any one of Aspects 1-25, wherein the composition further comprises an alginate material.

Aspect 27. The composition of Aspect 26, wherein the alginate material is a sodium alginate material.

Aspect 28. The composition of Aspect 26 or Aspect 27, wherein 1 wt % aqueous solution of the alginate material has a viscosity range from about 20 to about 400 centipoises at 20° C.

Aspect 29. The composition of any one of Aspects 26-28, wherein the alginate material has an average molecular weight of from about 10 kDa to about 500 kDa.

Aspect 30. The composition of Aspect 29, wherein the alginate material has an average molecular weight of from about 20 kDa to about 400 kDa.

Aspect 31. The composition of Aspect 29, wherein the alginate material has an average molecular weight of from about 30 kDa to about 300 kDa.

Aspect 32. The composition of Aspect 29, wherein the alginate material has an average molecular weight of from about 30 kDa to about 250 kDa.

Aspect 33. The composition of Aspect 29, wherein the alginate material has an average molecular weight of from about 30 kDa to about 200 kDa.

Aspect 34. The composition of any one of Aspects 26-33, wherein the alginate material has a degree of polymerization of from about 100 to about 1500.

Aspect 35. The composition of Aspect 34, wherein the alginate material has a degree of polymerization of from about 125 to about 1200.

Aspect 36. The composition of Aspect 34, wherein the alginate material has a degree of polymerization of from about 150 to about 1250.

Aspect 37. The composition of Aspect 34, wherein the alginate material has a degree of polymerization of from about 170 to about 1100.

Aspect 38. The composition of Aspect 34, wherein the alginate material has a degree of polymerization of from about 180 to about 950.

Aspect 39. The composition of any one of Aspects 26-38, wherein the alginate material is present in weight ratio to the boron nitride nanomaterial of from about 10:1 to about 1:10.

Aspect 40. The composition of Aspect 39, wherein the alginate material is present in weight ratio to the boron nitride nanomaterial of from about 5:1 to about 1:5.

Aspect 41. The composition of Aspect 39, wherein the alginate material is present in weight ratio to the boron nitride nanomaterial of from about 3:1 to about 1:3.

Aspect 42. The composition of Aspect 39, wherein the alginate material is present in weight ratio to the boron nitride nanomaterial of from about 2:1 to about 1:2.

Aspect 43. The composition of Aspect 39, wherein the alginate material is present in weight ratio to the boron nitride nanomaterial of from about 1.5:1 to about 1:1.5.

Aspect 44. The composition of Aspect 39, wherein the alginate material is present in weight ratio to the boron nitride nanomaterial of from about 1.2:1 to about 1:1.2.

Aspect 45. The composition of Aspect 39, wherein the alginate material is present in weight ratio to the boron nitride nanomaterial of from about 1.1:1 to about 1:1.1.

Aspect 46. The composition of any one of Aspects 1-45, wherein the composition further comprises an acid-based coagulant, an electrolyte coagulant, a plasticizer, a lipid, or combinations thereof.

Aspect 47. The composition of Aspect 32, wherein the plasticizer comprises a bio-based plasticizer.

Aspect 48. The composition of Aspect 33, wherein the plasticizer is an epoxidized soybean oil, castor oil, cardanol, citrate or derivative thereof, succinate or derivative thereof, isosorbide, or combinations thereof.

Aspect 49. The composition of Aspect 33 or Aspect 34, wherein the plasticizer is present in an amount from about 0.1 wt % to about 50% based on the dry mass of the composition.

Aspect 50. The composition of Aspect 49, wherein the plasticizer is present in an amount from about 0.1 wt % to about 40% based on the dry mass of the composition.

Aspect 51. The composition of Aspect 49, wherein the plasticizer is present in an amount from about 0.1 wt % to about 30% based on the dry mass of the composition.

Aspect 52. The composition of Aspect 49, wherein the plasticizer is present in an amount from about 0.1 wt % to about 20% based on the dry mass of the composition.

Aspect 53. The composition of Aspect 49, wherein the plasticizer is present in an amount from about 0.1 wt % to about 10% based on the dry mass of the composition.

Aspect 54. The composition of Aspect 49, wherein the plasticizer is present in an amount from about 0.1 wt % to about 5% based on the dry mass of the composition.

Aspect 55. The composition of Aspect 49, wherein the plasticizer is present in an amount from about 1 wt % to about 50% based on the dry mass of the composition.

Aspect 56. The composition of Aspect 49, wherein the plasticizer is present in an amount from about 5 wt % to about 50% based on the dry mass of the composition.

Aspect 57. The composition of Aspect 49, wherein the plasticizer is present in an amount from about 10 wt % to about 50% based on the dry mass of the composition.

Aspect 58. The composition of Aspect 49, wherein the plasticizer is present in an amount from about 25 wt % to about 50% based on the dry mass of the composition.

Aspect 59. The composition of Aspect 46, wherein the acid-based coagulant comprises citric acid.

Aspect 60. The composition of Aspect 46, wherein the electrolyte coagulant comprises a cationic polymer.

Aspect 61. The composition of Aspect 60, wherein the cationic polymer is a bio-based cationic polymer.

Aspect 62. The composition of Aspect 61, wherein the bio-based cationic polymer comprises chitosan.

Aspect 63. The composition of Aspect 46, wherein the lipid comprises a bio-based lipid.

Aspect 64. The composition of Aspect 63, wherein the bio-based lipid comprises cottonseed oil, sunflower oil, linseed oil, beeswax, or combinations thereof.

Aspect 65. The composition of Aspect 46 and 63-64, wherein the lipid is a component of an emulsion.

Aspect 66. A filament comprising the composition of any one of Aspects 1-65.

Aspect 67. A yarn comprising the filament of Aspect 66.

Aspect 68. The yarn of Aspect 67, wherein the yarn is composite or blended yarn further comprising cellulosic-based yarn, a polyester yarn, a polyamide yarn.

Aspect 69. A film, a sheet, a cast material, or a molded material comprising the composition of any one of Aspects 1-65.

Aspect 70. An article comprising the filament of Aspect 66, the yarn of Aspect 67, or the film, sheet, cast material, or molded material of Aspect 68.

Aspect 71. The article of Aspect 69, where the article is a fabric.

Aspect 72. The article of Aspect 70, wherein the article is a textile material.

Aspect 73. The article of Aspect 69, wherein the article is selected from a handbag, a shoe, an article of clothing, an article of sportswear, an article of drapery, a floor covering, a tote bag, a furniture cover, a tarpaulin, a car seat, and combinations thereof.

From the foregoing, it will be seen that aspects herein are well adapted to attain all the ends and objects hereinabove set forth together with other advantages which are obvious and which are inherent to the structure.

While specific elements and steps are discussed in connection to one another, it is understood that any element and/or steps provided herein is contemplated as being combinable with any other elements and/or steps regardless of explicit provision of the same while still being within the scope provided herein.

It will be understood that certain features and subcombinations are of utility and may be employed without reference to other features and subcombinations. This is contemplated by and is within the scope of the claims.

Since many possible aspects may be made without departing from the scope thereof, it is to be understood that all matter herein set forth or shown in the accompanying drawings and detailed description is to be interpreted as illustrative and not in a limiting sense.

It is also to be understood that the terminology used herein is for the purpose of describing particular aspects only, and is not intended to be limiting. The skilled artisan will recognize many variants and adaptations of the aspects described herein. These variants and adaptations are intended to be included in the teachings of this disclosure and to be encompassed by the claims herein.

Now having described the aspects of the present disclosure, in general, the following Examples describe some additional aspects of the present disclosure. While aspects of the present disclosure are described in connection with the following examples and the corresponding text and figures, there is no intent to limit aspects of the present disclosure to this description. On the contrary, the intent is to cover all alternatives, modifications, and equivalents included within the spirit and scope of the present disclosure.

EXAMPLES

The following examples are put forth so as to provide those of ordinary skill in the art with a complete disclosure and description of how the compounds, compositions, articles, devices and/or methods claimed herein are made and evaluated, and are intended to be purely exemplary of the disclosure and are not intended to limit the scope of what the inventors regard as their disclosure. Efforts have been made to ensure accuracy with respect to numbers (e.g., amounts, temperature, etc.), but some errors and deviations should be accounted for. Unless indicated otherwise, parts are parts by weight, temperature is in ° C. or is at ambient temperature, and pressure is at or near atmospheric.

Preparation of Nanocellulose-SA-hBN composition and Particle Size Reduction via ball milling: The components, i.e., a nanocellulose such as CNC or CNF, ALG (e.g., SA), and hBN, of the composition were dispersed using a planetary ball mill from Changsha Deco Equipment Co., Ltd. Without wishing to be bound by a particular theory, it is believed that milling, e.g., ball milling, can assist the dispersion and exfoliation of hBN into BNNS due to the strong hydrogen bonding interactions with CNC (or CNF when this material is used in lieu of or with CNC). Accordingly, it is believed that nanocellulose can act as an effective substance to cleave and functionalize the BNNS to remain dispersed through hydroxyl functionalization. In the studies described herein, the following materials were used: sodium alginate (Food grade, Mn=3.57×105, relative molecular mass distribution value: 1.392, and M/G value: 0.32) obtained from Lab Alley Essential Chemicals (Spicewood, Texas); CNC (product code CelluForce NCC® NCV100; CAS No. 9004-34-6; cellulose hydrogen sulfate sodium salt) was obtained from the CelluForce Inc. (Montreal, Quebec, Canada); TEMPO oxidized-CNF (TCNF) was obtained from the University of Maine; and hexagonal boron nitride was obtained from Bonding Chemical (Katy, Texas; catalog no. 352673: 99.3% boron nitride, 4-6 μm).

Before mixing within the planetary ball mill, 2 separate nanocellulose mixtures were prepared: (a) TEMPO oxidized CNF-hBN with a 1:1 mass ratio of hBN and CNF; and (b) and CNC-hBN with a 1:1 mass ratio of hBN and CNC. Each of these were mixed in deionized water under magnetic stirring for 10 minutes where the mass of hBN and nanocellulose represented 2% of the total solution mass. Following this step, the hBN and nanocellulose solutions were placed into four 500 mL zirconium oxide jar in which about ⅓ of the jar volume was filled with 1 mm-1.5 mm zirconium oxide balls and 1/3 of the jar volume was filled with the hBN-nanocellulose solution. The solutions were then milled at 500 rpm for 12 hours with a 1-hour break after the first 6 hours of milling.

ATR-FTIR spectrographs of CNC powder, hBN powder, and suspensions or dispersions there are provided in FIGS. 10A-10E.

heterogeneous mixture. DI water was added to the solution until hBN and CNC dry mass combined represented 2% of the total solution mass. After this initial mixing, the solution was processed through the high shear fluid processor to provide for proper functionalization and dispersion. On average, 25 passes were conducted at 10,000 psi 27,500 psi, and 28,000 psi with preferred results being obtained from the 25 passes at 28,000 psi. Processing under these conditions produces particle sizes as described in the Table 1 below and allows for a stable solution to form due to the functionalization of the hBN by the cellulosic polymer. This functionalization is believed to prevent the hBN from settling out of the solution because the cellulosic polymer minimizes the agglomeration of the hBN sheets. The particle size data in Table 1 were obtained using a HORIBA LA9950 Laser Diffraction Particle Size Analyzer (HORIBA Instruments Incorporated, Ann Arbor, Michigan).

TABLE 1

| Test | IXC Configuration | Pressure (psi) | # of passes | d10 (μm) | d50 (μm) | d90 (μm) | Mean (μm) |
|---|---|---|---|---|---|---|---|
| 20220526A | H30Z-G10Z | 28,000 | Unprocessed | 3.5546 | 6.4255 | 12.3407 | 17.39500 |
| | | | 1 | 1.6816 | 3.2170 | 5.4314 | 3.41926 |
| | | | 5 | 0.5414 | 2.3945 | 4.8933 | 2.61403 |
| | | | 10 | 0.3416 | 1.4725 | 3.8174 | 1.81385 |
| | | | 15 | 0.2795 | 0.9159 | 2.3824 | 1.17156 |
| | | | 20 | 0.1440 | 0.7143 | 1.6814 | 0.87693 |
| | | | 25 | 0.1358 | 0.6477 | 1.3847 | 0.75709 |
| 20220526B | | 10,000 | Unprocessed | 3.4888 | 5.7044 | 9.0595 | 6.03250 |
| | | | 1 | 2.1720 | 3.8975 | 6.2910 | 4.09578 |
| | | | 5 | 1.5907 | 3.0496 | 5.1428 | 3.24951 |
| | | | 10 | 1.3191 | 2.6287 | 4.5397 | 2.80839 |
| | | | 15 | 1.0976 | 2.5409 | 4.6173 | 2.72585 |
| | | | 20 | 0.8662 | 2.5141 | 4.7085 | 2.68543 |
| | | | 25 | 0.6762 | 2.3434 | 4.5244 | 2.51867 |
| 20220526C | H30Z-H10Z | 27,500 | Unprocessed | 3.1692 | 5.2357 | 8.1116 | 5.47826 |
| | | | 1 | 1.6683 | 3.1417 | 5.2421 | 3.33414 |
| | | | 5 | 0.7000 | 2.4764 | 4.8052 | 2.66441 |
| | | | 10 | 0.3657 | 1.7250 | 4.0148 | 1.99291 |
| | | | 15 | 0.2785 | 1.0647 | 2.9296 | 1.36921 |
| | | | 20 | 0.2319 | 0.8256 | 2.0860 | 1.04143 |
| | | | 25 | 0.1453 | 0.6884 | 1.5164 | 0.81648 |

Figure 5:
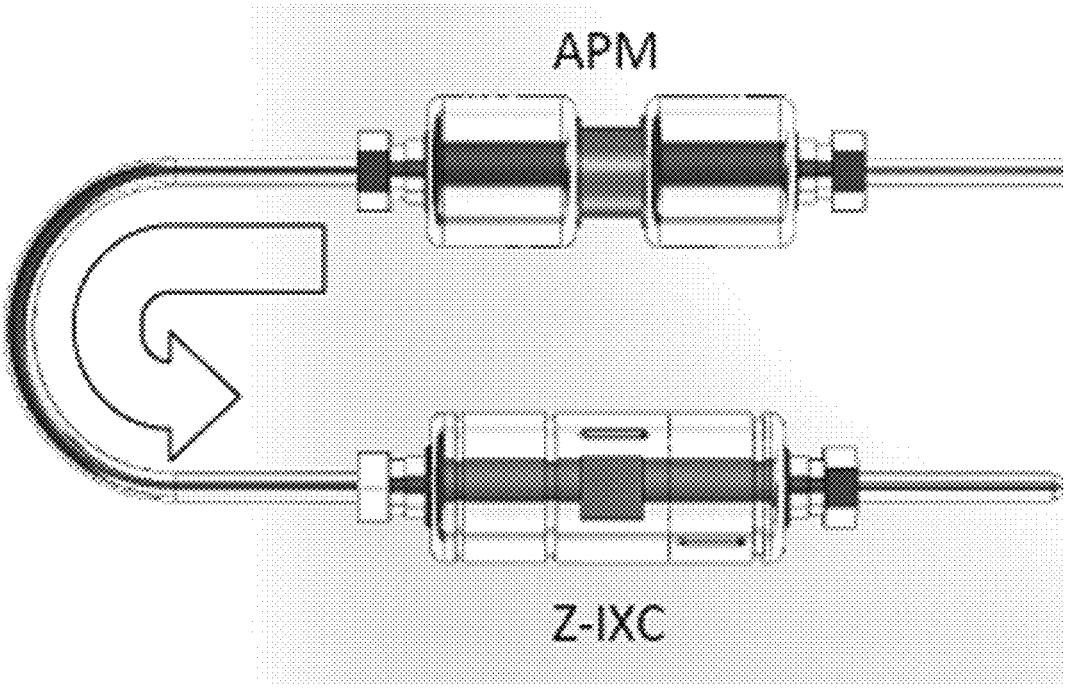
FIG. 5 shows a representative side-view schematic representation of a microfluidizer that can be used with the disclosed methods and processes.

Preparation of CNC-SA-hBN composition and Particle Size Reduction via high-sheer fluidizing: It is believed that dispersion of hBN into an aqueous solution is facilitated by particle size reduction and functionalization in order to achieve BNNS (hexagonal boron nitride nano sheets) that is capable of forming a stable solution. In one exemplary method, this can be done using high sheer forces and a polymer solvent that functionalizes the hBN to accomplish both particle size reduction and functionalize in a single step. In the present example, this was carried out using a high shear fluid processor (Microfluidizer® M110EH, Microfluidics International Corporation, Westwood, Massachusetts; see FIG. 5 for a schematic representation of this high shear fluid processor). The high shear fluid processor used herein can reach pressures of up to 30,000 psi while using an 87-micron Z-shaped diamond interaction chamber (Z-IXC) and a standard after processing unit (APM). A series of different pressures can be used to breakdown and disperse the hBN into the CNC, CNF, or tempo CNF polymer solvents. The standard mixture used and displayed below in Table 1 is a 6.67 wt % CNC aqueous solution mixed with 5-micron hBN at a 1:1 ratio of dry CNC mass to dry hBN mass to provide a total 2 wt % solution based of draw mass. Briefly, both the cellulosic solvent and the hBN powder were magnetically stirred in a beaker to obtain a In the present example, referring now to FIG. 5 which shows the interaction chambers of the high shear fluid processor used. The exfoliating solution (e.g., a solution prepared as described herein comprising CNC and hBN, CNF and hBN, and/or TEMPO-CNF and hBN), is process first through the APM chamber, then through the 87-micron diamond z channeled interaction chamber (labeled as Z-IXC in FIG. 5) in order to exfoliate and functionalize the hBN, thereby forming a stable solution.

Mixing of sodium alginate into hBN/CNC and hBN/CNF and hBN/tempo-CNF solutions. In order to mix sodium alginate into the milled dispersion, a Silverson L5-MA High Shear Mixer was used (Silverson Machines, Inc., East Longmeadow, Massachusetts). Sodium alginate was added to the dispersion under 7000 rpm of mixing until the total mass of SA was 2% of the total solution mass. The final dispersion was mixed for approximately 7 minutes or until there were no signs of agglomerates. The final dispersions were SA-hBN-CNC and SA-hBN-CNF as the cellulose nanocrystal and cellulose nanofiber compositions, respectively.

Film casting procedure: In order to evaluate flame resistance, fire resistance, and UV-absorption properties of the disclosed compositions, exemplary compositions comprising either SA-hBN-CNC or SA-hBN-TCNF were each cast into a thin film. Briefly, 7 mL of each composition was poured into a 56 mm glass evaporating dish. The dishes were placed into a convection oven at 40° C. for 15 hours where the final thickness of the films on average was 870 microns. Fire resistance of SA-hBN-CNC was evaluated by casting the disclosed composition into a slightly thicker film than what was originally cast into the glass dish. To prepare this film, 500 ml of the SA-hBN-CNC composition was poured into a 30 cm×15 cm metal pan. The pan was also placed into the same convection oven at 40° C. for 15 hours until dry. 12.7 mm×101.6 mm×1.08 mm dry samples were cut from the pan-cast films. Control sample films were cast as described above from: (a) 2 wt % SA solution; and (b) 1 wt % TEMPO, 2,2,6,6-Tetramethylpiperidinyloxy oxidized cellulose nanofiber solution.

Figures 6A, 6B, 6C:
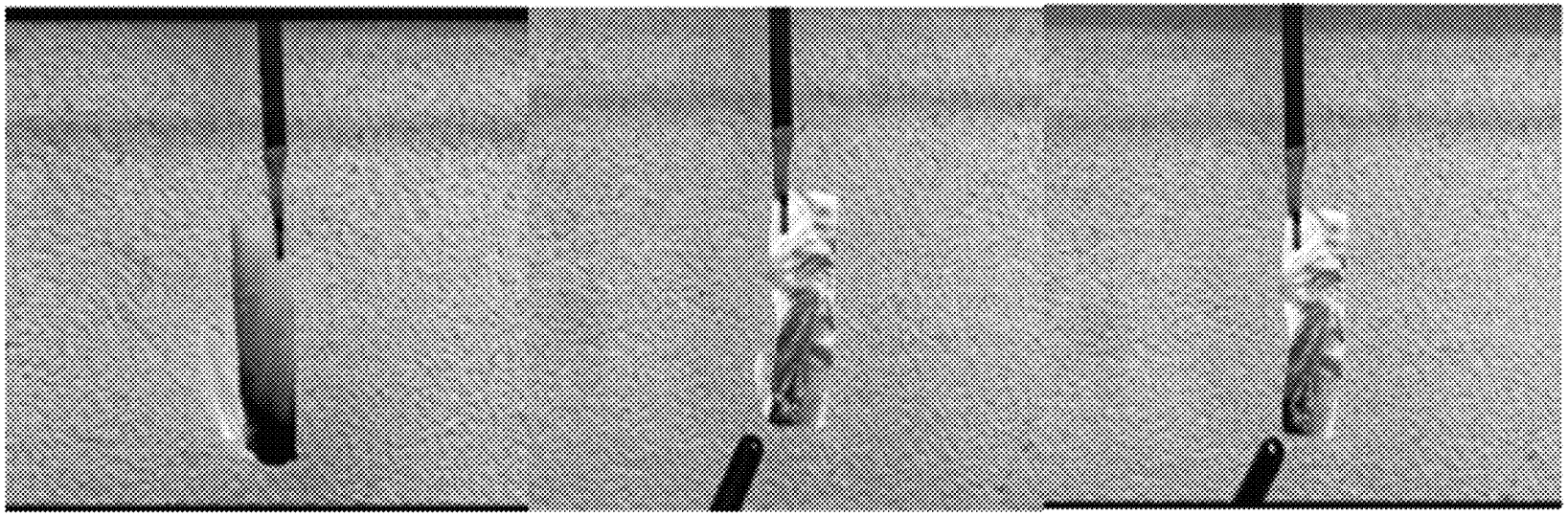
FIGS. 6A-6C show representative photographic images of a flame resistance test carried out on a disclosed material.

Flame Resistance: A simple test based on an adjusted NFPA vertical film flame test was conducted. 12.7 mm×101.6 mm samples were made and an open flame from a lighter was applied to the bottom edge of the sample for 12 seconds. The disclosed composition along with a pure alginate film were compared for their fire-resistant properties. After 12 seconds of exposure on the alginate film, a flame persisted and spread approximately 1.5 inches through the sample. A disclosed composition prepared from 2 wt % Sodium Alginate and 2 wt % CNC/BNNS (equal ratio) underwent the same test and it was observed that the flame did not spread with only a simple char layer formed which prevented further burning of the sample. Exemplary results are shown in FIGS. 6A-6C.

Figure 7:
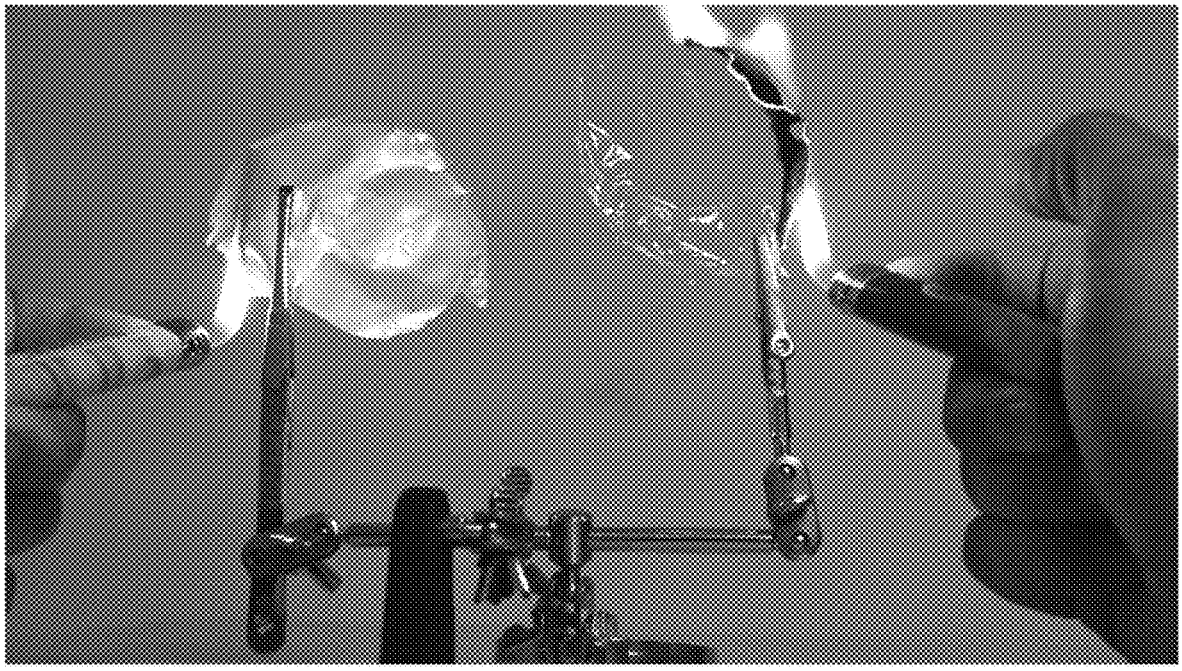
FIG. 7 shows a representative photographic image of a flame resistance test carried out on a disclosed film compared to a control film lacking the disclosed composition. On the left side of the image is a disclosed film comprising a disclosed composition comprising sodium alginate, TEMPO-oxidized carbon nanofibers (TCNFs) and hBN (1:1:1 weight ratio), whereas the right side shows a film comprising TCNFs.

Fire Resistance: The fire-resistant properties of SA-hBN-TCNF properties were tested against a film comprising only TCNF. Through visual inspection, 12 seconds of open flame exposure on SA-hBN-TCNF exhibited minimal flame travel throughout the film. Similar to the SA-hBN-CNC vertical flame test films, a char layer formed at the exposure site which aided in preventing flame growth and further ignition. A pure TCNF film under open flame exposure exhibited immediate degradation and continued to burn even after the flame source was removed. Exemplary testing is shown in FIG. 7. The limiting oxygen index ("LOI") of the disclosed composition can range from 0% to 40% LOI.

Figure 8B:
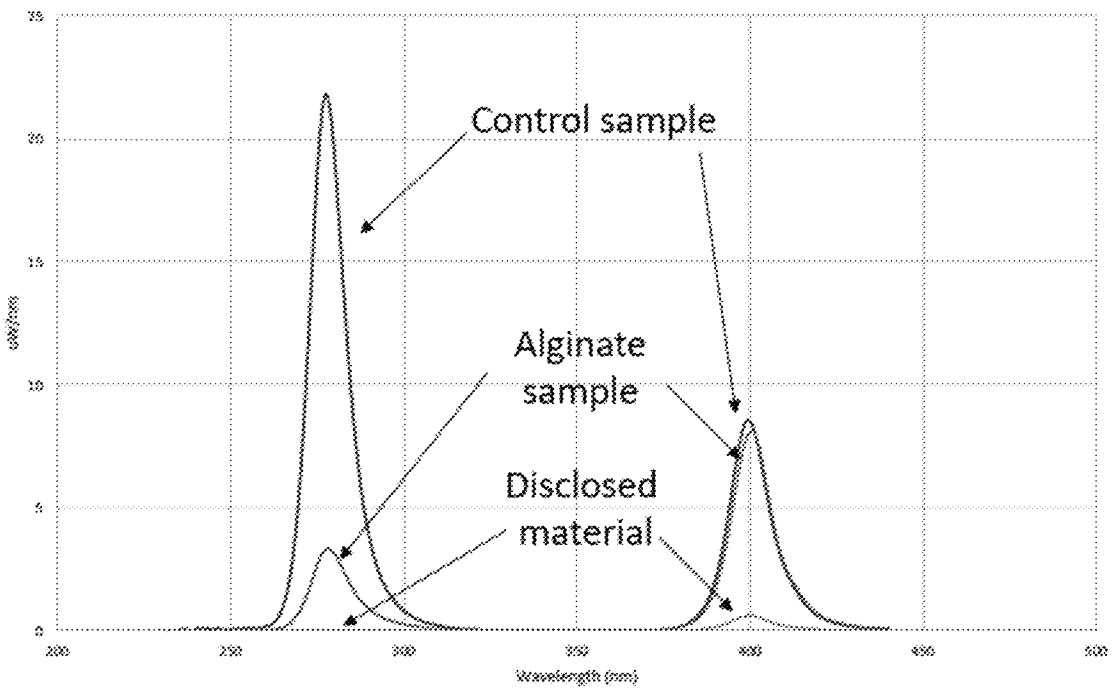
FIGS. 8A-8B show a schematic depiction of UV absorption testing method and representative data for a disclosed material.
Figure 8A:
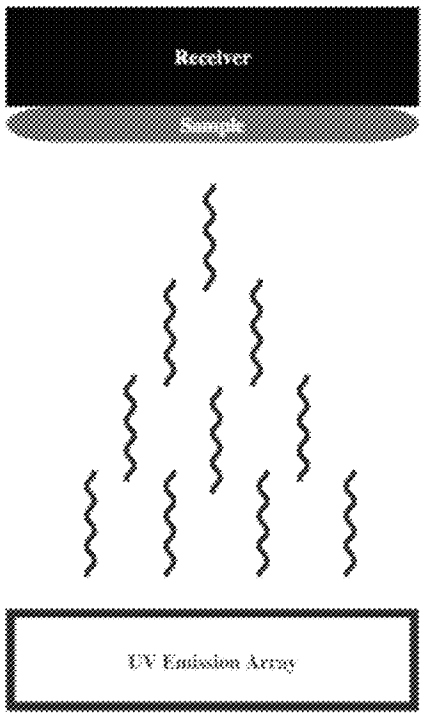
Figure 9:
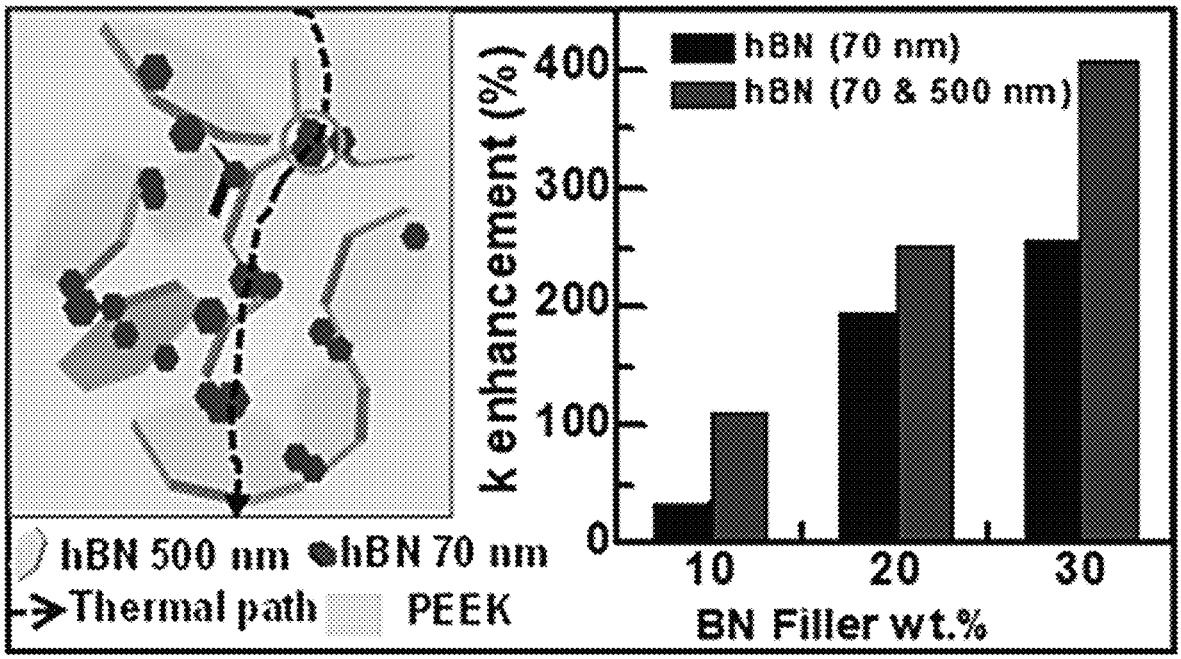
FIG. 9 shows: (left panel) a model of heat transport of hexagonal boron nitride in a PEEK synthetic polymer composite in which the mean free path of phonon transfer is minimized; and (right panel) representative data for thermal conductivity for the same sample with hexagonal boron nitride of the indicated size and wt %. The model depicted in FIG. 9 is from the prior art (see Ghosh, B., Xu, F. and Hou, X. J Mater Sci 56, 10326-10337 (2021)).
Figure 10A:
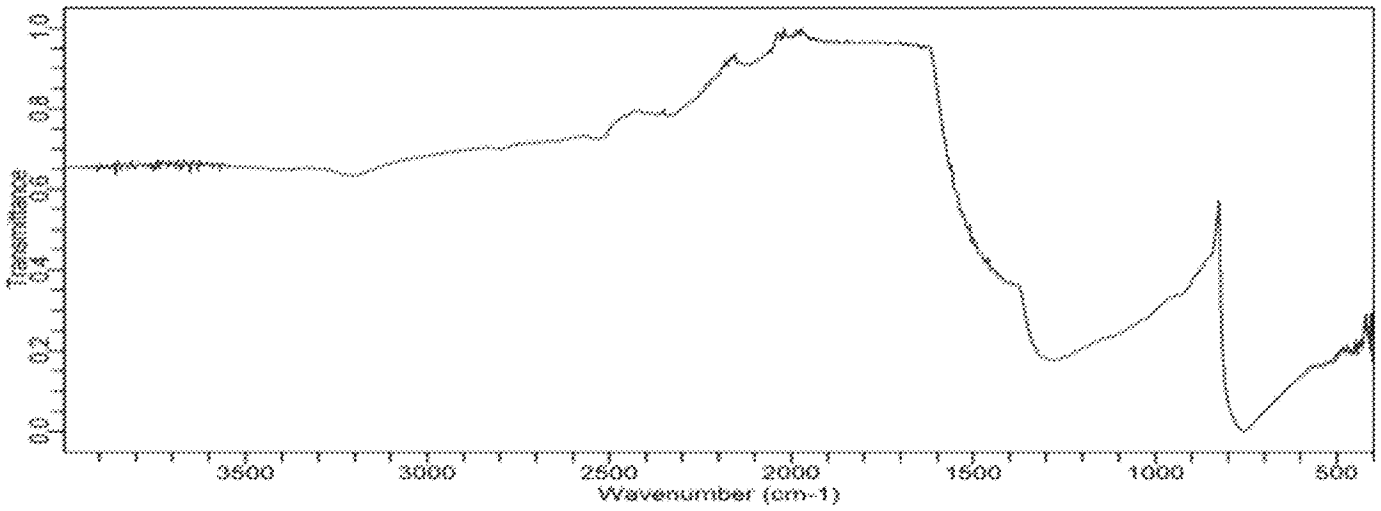
FIGS. 10A-10E show representative ATR-FTIR spectrographs obtained of CNC powder at different steps of the disclosed method. The data were obtained using a wavenumber range of 4000-400 cm-1 with 128 sample scans and 128 background scans.
Figure 10B:
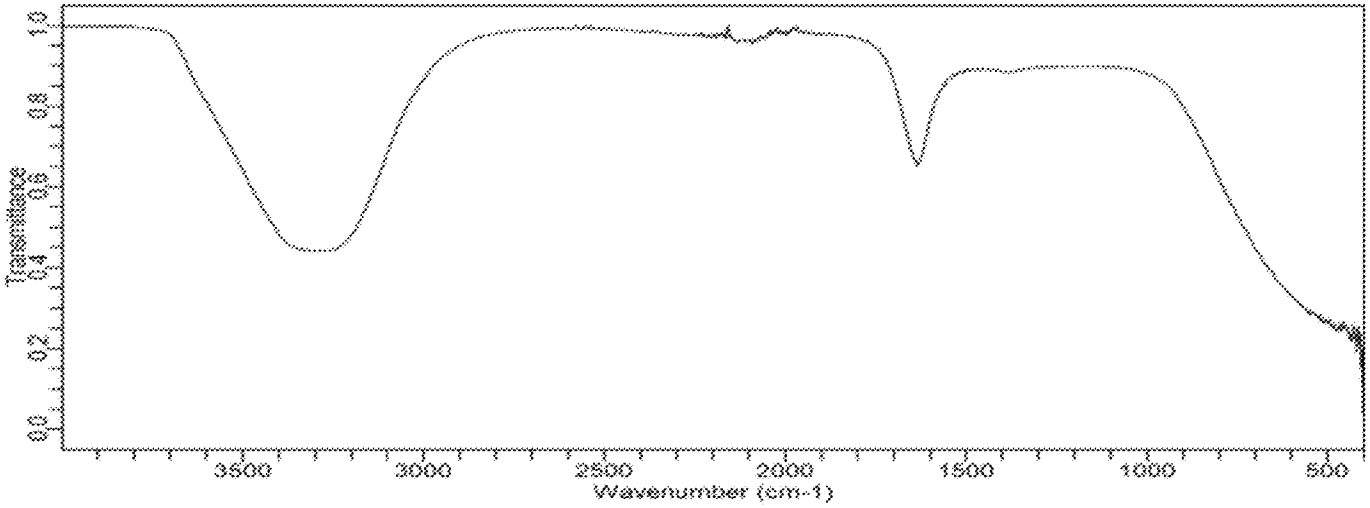
Figure 10C:
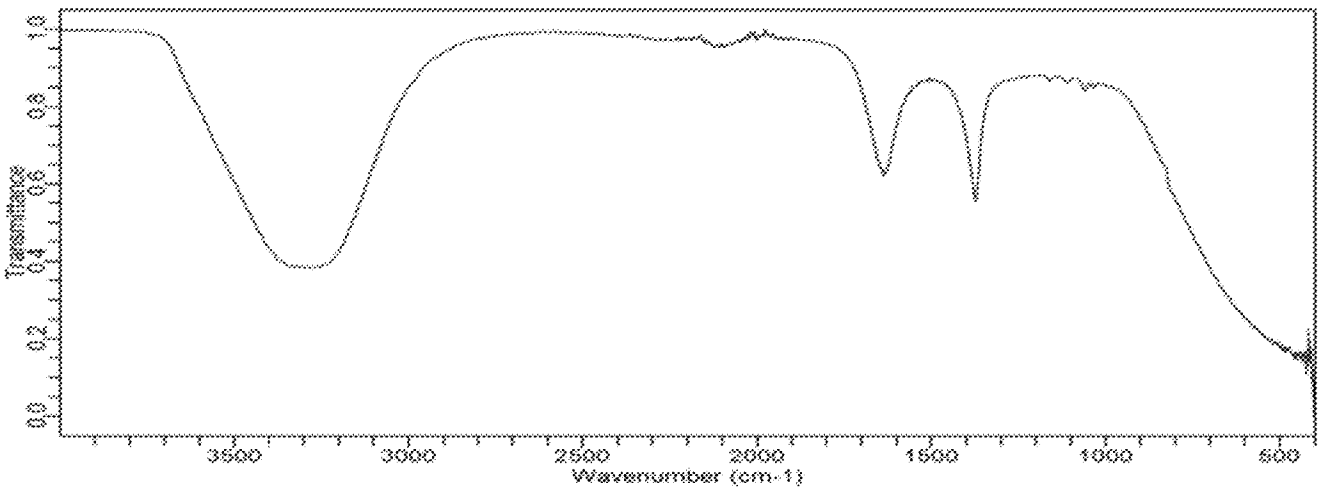
Figure 10D:
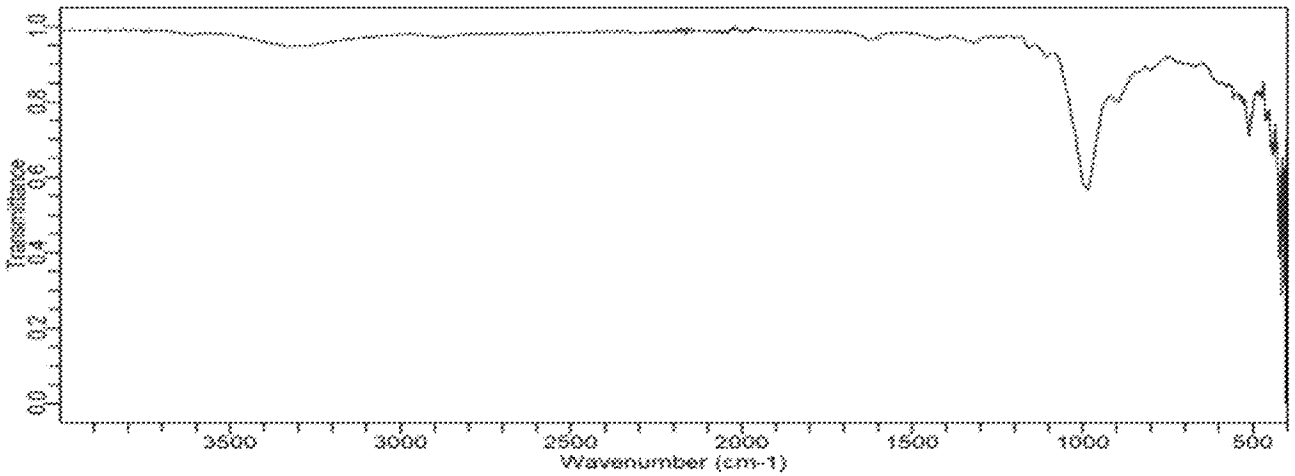
Figure 10E:
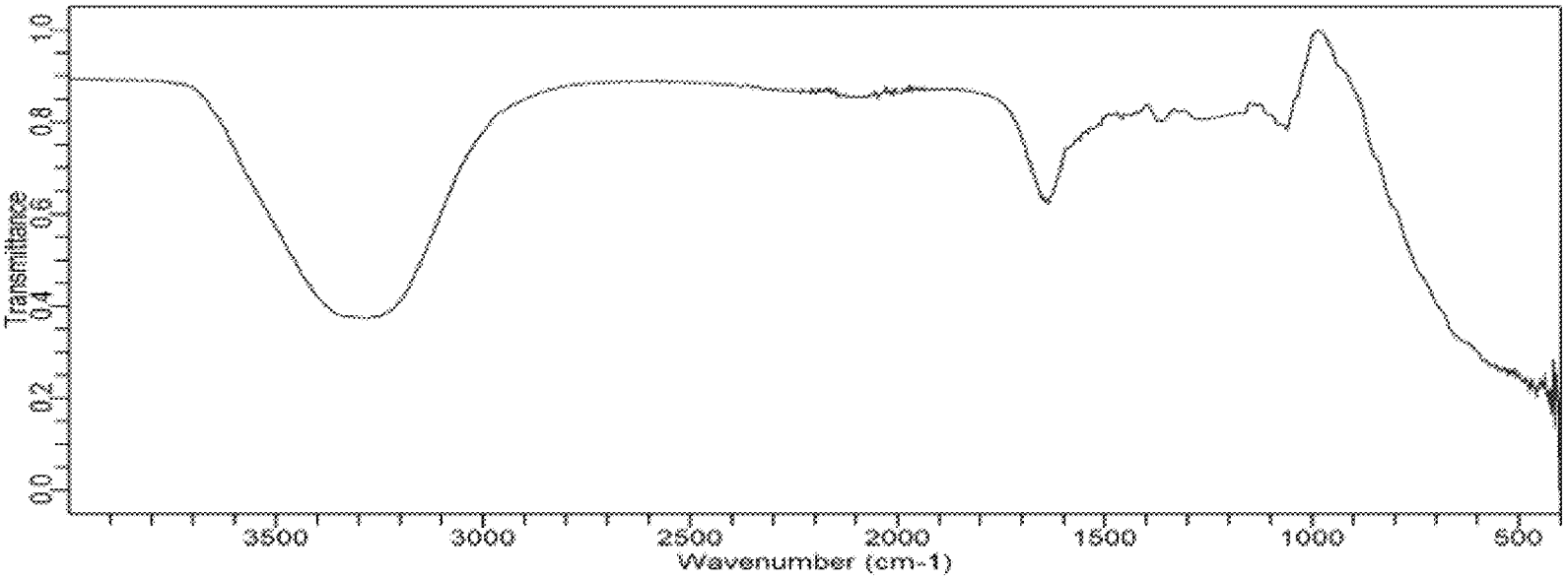

UV Absorption: UV Absorption tests were conducted using a UV-C and UV-A LED array emitting wavelengths in the range 275-395 nm. A hBN-SA-CNC 56 mm film was tested against the pure alginate control samples. The array was placed approximately 4 inches away from the UV absorption receiver while the films being tested had direct contact with the receiver as displayed (see FIG. 8A). The disclosed composition absorbed 100% of UV-C and 93% of UV-A, whereas a film comprising only alginate absorbed 86% of UV-C and 0.7% UV-A (see FIG. 8B).

Preparation of Exemplary Disclosed Artificial Leather—Pre-Processing. The initial steps are similar to those described above for disclosed films, i.e., hBN and CNC were functionalized and dispersed in suspension using high shear mixing. The exemplary disclosed artificial leathers utilize a cellulose component such as CNC, pristine CNF, and TCNF, as well as carboxymethylated cellulose (CMC), and mixtures thereof. In general, a 1:1 mass ratio of the cellulose (CNC, CNF, TCNF, CMC and mixtures thereof) were used in which the total wt % of cellulose and hBN in the suspension varied between about 0.5 wt % to 10 wt %. Upon completion of exfoliation in suspension, the suspension was diluted, as necessary, to a working concentration of from about 1-5 wt %. Then an overhead mixer (e.g., a Silverson overhead mixer) was used to mix while preparing the diluted working solution, e.g., a 1 wt % total suspension (total weight of CNC and hBN) was prepared from a concentrated exfoliated suspension comprising 10 wt % CNC and 10 wt % hBN. During preparation of the working solution, additive components as, described herein above, can be added to the working suspension, e.g., plasticizers, lipids, oils, glycerol, pristine CNF or other cellulose materials, and the like. An exemplary artificial leather composition working solution is described in Table 2 below.

TABLE 2

| Material | Total mass of solution (750 g*) | Weight percent (wt %) |
|---|---|---|
| Sodium algainte (powder) | 15 g | 2% |
| Glycrol | 15 g | 2% |
| Sunflower oil | 11.25 g | 1.5% |
| CNC | 7.5 g | 1% |
| Hbn | 7.5 g | 1% |
| 3% solution of CNF | 7.5 g | 1% |

*Balance of mass is water.

Preparation of Exemplary Disclosed Artificial Leather—Processing. Following the pre-processing method described immediately above, the working solution comprising the cellulose component, hBN, and additive components, the solution was degassed under vacuum, e.g., placing the working solution into a vacuum chamber at about 1-5 atm, for 1-30 minutes at room temperature to remove trapped air in the working solution. The degassed working solution was then poured into molds with a backing material on at least surface of the mold (usually the largest surface area portion of the mold). The backing materials used can comprise, but are not limited to, cotton, hemp, flax, jute, or bamboo. The backing materials can be loose short or long fibers, woven textile materials comprising these materials, knitted textile materials comprising these materials, non-woven textile materials comprising these materials, and combinations thereof. The mold can provide a molded material having a thickness of suitable thickness, e.g., from about 0.1 mm to about 25 mm. The material was dried in mold using a convection oven, dehydrator, or infrared heating/drying system. In a particular example, the material was dried in mold at about 35° C. (e.g., about 33° C. to about 37° C.) for about 24 hours. The desirable temperature used can be from about 25° C. to about 40° C. Following drying, the dried molded article is removed from the mold and then immersed in a calcium chloride solution (about 1-10 wt %) to effect ionic cross-linking at about −20 to 30° C. for a period for from about 1 hour to about 30 hours. The cross-linked molded material is rinsed with deionized water, and then placed in 100% ethanol (or alternatively a ketone or other alcohol such as acetone or isopropanol) to effect final removal of water.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

What is claimed is:

1. A composition comprising an alginate material, a boron nitride nanomaterial and a cellulose nanomaterial, wherein:

wherein the boron nitride nanomaterial comprises exfoliated boron nitride;

wherein the exfoliated boron nitride nanomaterial comprises boron nitride nanosheets;

wherein the boron nitride nanosheets have an average thickness of from about 1 nm to about 50 nm;

wherein the cellulose nanomaterial comprises cellulose nanofibers, cellulose nanocrystals, or combinations thereof;

wherein the alginate material is present in weight ratio to the boron nitride nanomaterial of from about 10:1 to about 1:10; and wherein the boron nitride nanomaterial and the cellulose nanomaterial are present in a weight ratio of from about 10:1 to about 1:10.

2. The composition of claim 1, wherein the boron nitride nanosheets have an average thickness of from about 5 nm to about 15 nm.

3. The composition of claim 1, wherein the cellulose nanomaterial comprises cellulose nanofibers having an average diameter of less than about 500 nm.

4. The composition of claim 1, wherein the cellulose nanomaterial comprises cellulose nanocrystals having an average particle size of less than about 500 nm in the longest dimension.

5. The composition of claim 1, wherein the boron nitride nanomaterial and the cellulose nanomaterial are present in a weight ratio of from about 5:1 to about 1:5.

6. The composition of claim 1, wherein the alginate material is a sodium alginate material.

7. The composition of claim 1, wherein the alginate material has a degree of polymerization of from about 100 to about 1500.

8. The composition of claim 1, wherein the composition further comprises a component selected from an acid-based coagulant, an electrolyte coagulant, a plasticizer, a lipid, and combinations thereof.

9. The composition of claim 8, wherein the plasticizer is an epoxidized soybean oil, castor oil, cardanol, citrate or derivative thereof, succinate or derivative thereof, isosorbide, or combinations thereof.

10. The composition of claim 8, wherein the acid-based coagulant comprises citric acid.

11. The composition of claim 8, wherein the electrolyte coagulant comprises a cationic polymer.

12. The composition of claim 11, wherein the cationic polymer comprises chitosan.

13. The composition of claim 8, wherein the lipid comprises cottonseed oil, sunflower oil, linseed oil, beeswax, or combinations thereof.

14. A filament comprising the composition of claim 1.

15. A yarn comprising the filament of claim 14.

16. An article comprising the filament of claim 14.

17. A film, a sheet, a cast material, or a molded material comprising the composition of claim 1.

18. An article comprising the film, the sheet, the cast material, or the molded material of claim 17.

* * * * *